US006412421B2

(12) United States Patent
Dohr et al.

(10) Patent No.: US 6,412,421 B2
(45) Date of Patent: Jul. 2, 2002

(54) GATE ASSEMBLY FOR A RAILROAD HOPPER CAR

(75) Inventors: Jeremy J. Dohr, Kenosha; Brian A. Senn, South Milwaukee, both of WI (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 09/827,621

(22) Filed: Apr. 6, 2001

Related U.S. Application Data

(62) Division of application No. 09/156,430, filed on Sep. 18, 1998.

(51) Int. Cl.[7] ..... B61D 7/20

(52) U.S. Cl. ..... 105/282.2; 105/247; 105/282.1; 105/282.3; 406/130

(58) Field of Search ..... 105/282.1, 282.2, 105/282.3, 247, 310.1; 406/130

(56) References Cited

U.S. PATENT DOCUMENTS

| | | | | |
|---|---|---|---|---|
| 3,316,030 | A | 4/1967 | Kemp | |
| 3,332,363 | A | 7/1967 | Becker | 105/280 |
| 3,360,302 | A | * 12/1967 | Bagguley | 406/130 |
| 3,373,884 | A | * 3/1968 | Dorey | 406/130 |
| 3,393,017 | A | 7/1968 | Smith | |
| 3,415,204 | A | 12/1968 | Pase | 105/282.2 |
| 3,446,538 | A | 5/1969 | Danielson | |
| 3,451,716 | A | 6/1969 | Nagy | |
| 3,529,747 | A | 9/1970 | Mundinger | |
| 3,536,013 | A | 10/1970 | Nagy | 105/282.2 |
| 3,578,815 | A | 5/1971 | Mundinger | 105/282.2 |
| 3,580,642 | A | 5/1971 | Nagy | 105/282.2 |
| 3,650,567 | A | 3/1972 | Danielson | 105/282.2 |
| 3,708,209 | A | 1/1973 | Dugge | 105/282.2 |
| 3,779,172 | A | 12/1973 | Schipper et al. | 105/282.2 |
| 3,831,803 | A | 8/1974 | Hutchinson | 105/280 |
| 3,843,204 | A | 10/1974 | Fischer | 105/282.2 |
| 3,845,726 | A | 11/1974 | Fuller | 105/282.2 |
| 4,344,365 | A | 8/1982 | Fritz et al. | 105/282.2 |
| 4,360,295 | A | 11/1982 | Anderson | 105/282.2 |
| 4,376,542 | A | * 3/1983 | Hennessy | 105/282.3 |
| 4,450,773 | A | * 5/1984 | Fritz et al. | 105/282.2 |
| 4,528,913 | A | * 7/1985 | Randolph | 105/282.3 |
| 4,568,224 | A | 2/1986 | Dugge et al. | |
| 4,617,868 | A | 10/1986 | Wahlstrom et al. | 105/282.2 |
| 5,005,490 | A | 4/1991 | Overheidt | 105/282.2 |
| 5,353,513 | A | 10/1994 | Dohr et al. | 105/282.2 |
| 5,613,446 | A | 3/1997 | DiLuigi et al. | 105/282.2 |
| 5,671,684 | A | 9/1997 | Lucas | 105/305 |
| 5,829,359 | A | 11/1998 | Dohr et al. | 105/310 |
| 6,012,397 | A | 1/2000 | Krahl et al. | 105/286 |
| 6,073,562 | A | 6/2000 | Cozine | 105/247 |
| 6,123,030 | A | 9/2000 | Dohr et al. | 105/282.2 |

* cited by examiner

*Primary Examiner*—S. Joseph Morano
*Assistant Examiner*—Lars A. Olson
(74) *Attorney, Agent, or Firm*—John W. Harbst

(57) ABSTRACT

A gate assembly for a railroad hopper car is disclosed. The gate assembly includes a frame defining a discharge opening, a slidable door mounted on the frame for movement between a closed position, wherein the door closes the discharge opening, and an open position, wherein the door is positioned to allow commodity to pass through the discharge opening. Either of two modular components can be arranged in combination with the door on the gate assembly to allow the gate assembly to be conditioned for either pneumatic and/or gravitational discharge or gravitational discharge only of commodity from the gate assembly. A drive mechanism including an apparatus for selectively engaging either the door or either of the modular elements arranged in association with the door is mounted on the frame of the gate assembly, with the apparatus of the drive mechanism preferably being lost motion connected to the door. Seal structure is provided in combination with the frame, door and a modular element for inhibiting debris from contaminating the door and a discharge plenum defined by the frame of the gate assembly.

18 Claims, 14 Drawing Sheets

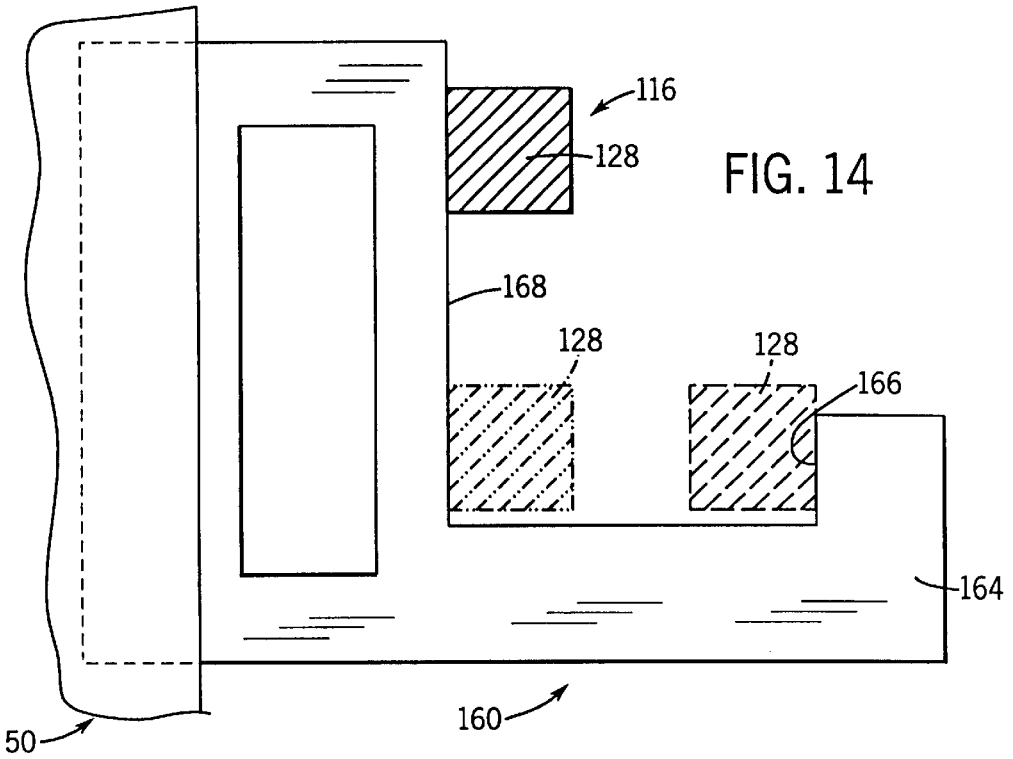
FIG. 14
FIG. 19
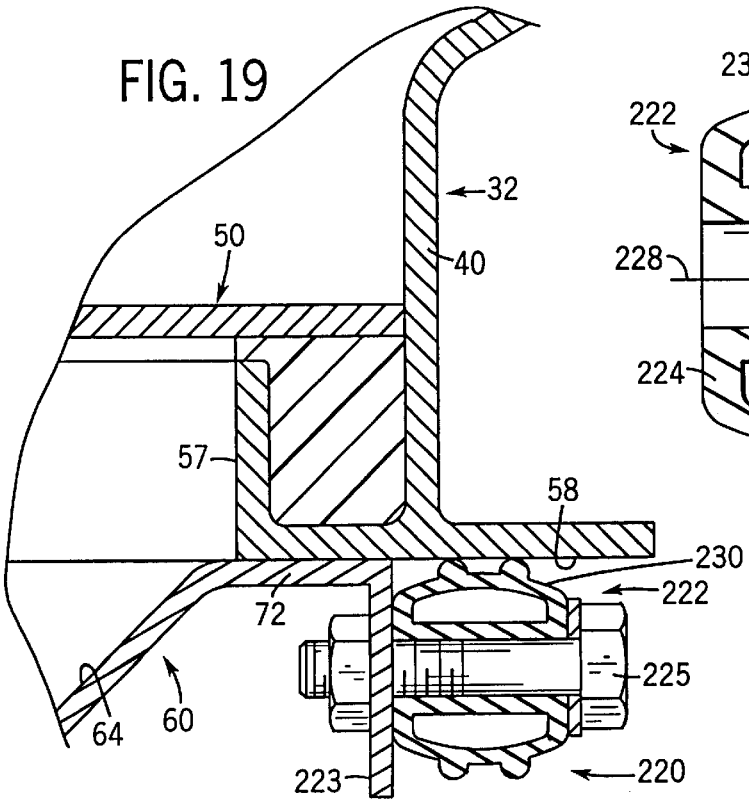
FIG. 20
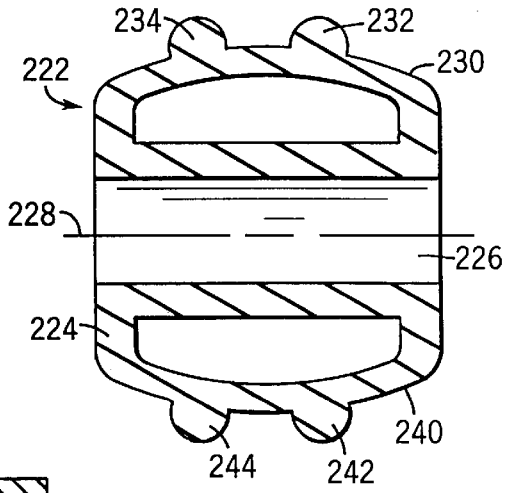

GATE ASSEMBLY FOR A RAILROAD HOPPER CAR

This application is a division, of application Ser. No. 09/156,430 filed Sep. 18, 1998.

FIELD OF THE INVENTION

The present invention generally relates to gate assemblies which are adapted for use in combination with railroad hopper cars and through which lading, such as finely comminuted or granulated food grade commodities are discharged and, more specifically, to a gate assembly having interchangeable modular components allowing the gate assembly to be easily and readily conditioned for either pneumatic discharge or sanitized gravitational discharge of lading from the hopper car and through the gate assembly.

BACKGROUND OF THE INVENTION

Rail road hopper cars typically include an underframe for supporting a walled enclosure in which lading is held and transported. As is conventional, the underframe of the car is supported toward opposite ends by well known wheeled trucks which ride on tracks or rails. The bottom of the walled enclosure is usually provided with two or more individual discharge openings for allowing the lading to be discharged from the walled enclosure. The walled enclosure furthermore typically includes sloped or slanted walls or sheets extending upwardly from a periphery of each opening to promote gravitation al movement of the lading toward the opening.

Various methods and devices are known in the art for individually closing the discharge openings in the walled enclosure. Basically, such closure devices or gate assemblies are divisible into two categories. Some hopper cars utilize a sliding door or valve type system for selectively opening and closing the openings at the bottom of the walled enclosure. Alternatively, some hopper cars are provided with pneumatically enabled discharge systems which rely on a pressure differential system for exhausting particulate matter or lading from the enclosure of the hopper car.

A conventional slide gate system includes a frame which is bolted or otherwise secured to the hopper car. The frame likewise defines a discharge opening arranged in registry with the opening at the bottom of the slanting walls on the hopper car. A gate or door is arranged on the frame for sliding movement along a generally horizontal path of travel between open and closed positions relative to the discharge opening on the frame of the gate assembly. A door operating mechanism including one or more racks, typically secured or attached to the door, and rotatably driven pinions is typically used to slide the door between open and closed positions. In an open position, the door of the gate assembly permits the contents of the hopper car enclosure to pass gravitationally from the walled enclosure and through the discharge opening defined by the gate assembly. In a closed position, the door extends across the discharge opening on the frame to shut off the material or matter flow through the gate assembly.

A conventional pneumatic discharge system for hopper cars involves connecting a discharge assembly including a pan-like housing beneath each opening in the bottom of the hopper car. A pneumatic discharge conduit extends from at least one of the sides the pan-like housing in a direction generally normal to a longitudinal axis of the car. One end of the pneumatic conduit opens to the interior of the pan-like housing while an opposite end is adapted for connection to a suction hose or the like for conducting the lading held and stored within the walled enclosure to any suitable discharge station.

The transportation and unloading of finely divided materials, and particularly food stuffs, such as sugar, flour and the like within and from the walled enclosure of the hopper car exacerbates the problems involved with the design and engineering of a railroad hopper car discharge gate assembly. When the lading to be transported involves food stuffs, the FDA has promulgated certain rules and regulations which must be met in order for the hopper car to qualify for transporting food stuffs. Of course, one of the paramount concerns involves designing the hopper car discharge gate assembly such that no foreign matter, accumulation of moisture, or insect infiltration is permitted to contact and possibly contaminate the food stuffs even while they are being discharged or unloaded from the railway hopper car.

Sliding gate closure systems have proven adequate over the years. There are, however, problems inherent with these designs. It is common practice to load a hopper car through roof hatches. The lading, when initially introduced into the walled enclosure, is mixed with air and is very fluid. After standing and as the car travels, however, the lading loses the air film from the finely divided particles and the lading settles and becomes very compact.

As mentioned, the discharge gate assembly is mounted at the bottom of the walled enclosure and, in sliding gate systems, the door must be slidably moved against the friction imposed thereon by the load. Known slide gate systems for hopper cars have relatively large doors to effect discharge of the lading in a timely and efficient manner. Once the door has begun movement, it can be moved through its path of travel with a reasonable amount of torque or input to the door operating mechanism. At the onset of door travel toward an open position, however, such sliding gate systems require a relatively high initial opening force to be imparted to the door.

In those hopper cars which transport food stuffs and utilize a sliding gate for controlling the discharge of lading from the walled enclosure of the hopper car, the frame of the gate assembly is usually equipped with a flanged skirt depending from and arranged in surrounding relation relative to the discharge opening defined by the frame of the gate assembly. The flanged skirt defines a discharge plenum. Typically, an air sled or other form of unloading apparatus is clamped to the flanges on the skirt during a discharge operation thereby permitting the food stuffs in the enclosure of the hopper car to be discharged directly and protectively into the sled and, thus, conveyed away from the hopper car. To inhibit debris, insects, moisture, clay and other forms of debris from contaminating the underside of the door and interior of the discharge plenum during transport of the hopper car, such sliding gate systems typically include a sanitary plate or cover plate which slides between open and closed positions in a horizontal plane generally parallel to the door to close the discharge plenum and protect the underside of the door during transport of the hopper car. Of course, known sanitary plates or cover plates are neither designed nor configured to withstand the load which can be placed thereon by the commodity in the enclosure of the hopper car.

Another problem has been identified with sliding gate systems when the lading in the walled enclosure involves fine granular food stuffs. As will be appreciated, to enable the sliding door to operate between positions, an operating gap or opening must be provided between the frame of the gate assembly and the door. Such gap or opening is typically provided between the skirt on the frame and the door. It is through this opening that contaminants, moisture, and related debris can enter the discharge plenum, thus, contaminating the food stuffs upon discharge of the lading from the hopper car and through the discharge plenum.

Arranging seals or gaskets about the discharge opening of the gate assembly frame in an attempt to close or seal such openings has often resulted in the seal or gasket being pulled from the gate assembly. The racks on the door coupled with the sliding movement of the door between open and closed positions further complicate the ability to seal the door against contaminants passing into the discharge plenum or opening on the frame of the gate assembly. Moreover, the required need to seal an element of the gate assembly movable in opposite linear directions furthermore complicates the sealing ability of the gate assembly.

It is known in the art to mount a pan-like structure or housing including the pneumatic discharge conduit to the frame of the gate assembly beneath the sliding door. The pan-like structure or housing is typically fastened to the walled enclosure of the hopper car beneath the sliding door with a plurality of fasteners. As such, the hopper car can function in either a gravitational discharge mode or a pneumatic discharge mode. Of course, valuable time is consumed and lost by affixing and removing the pan-like housing from the hopper car depending upon which type of discharge operation is required or desired. Mounting and arranging the pan-like structure or element above the sliding door of the gate assembly has been found to obstruct the flow of material from the walled enclosure in a gravitational mode of material discharge. Moreover, it is desirable to provide only a single drive mechanism for operating the components of the gate assembly thereby simplifying its operation.

Thus, there remains a need and a desire for a gate assembly for a railroad hopper car which can be conditioned for either pneumatic or gravitational discharge of lading from the walled enclosure of the hopper car and which utilizes but a single operating mechanism for operating the components of the gate assembly in timed relation relative to each other. Moreover, it is desirable to provide a gate assembly for a railroad car having a sliding door and wherein the operating mechanism imparts a high impactual opening force against the door during initial stages of its movement toward an open position. Additionally, there is a need and desire for a gate assembly for a railroad hopper car including modular components permitting the gate assembly to be easily and readily conditioned for pneumatic and/or gravitational discharge or gravitational discharge only simply by interchanging the components thereof.

SUMMARY OF THE INVENTION

In view of the above, one of the salient features of the present invention involves the provision of a railroad car discharge gate assembly which can be easily and readily conditioned for either pneumatic and/or gravitational discharge or gravitational discharge only of materials therethrough. As is conventional, the gate assembly of the present invention includes a rigid frame preferably having a rectangular configuration and defining a generally centralized discharge opening. Moreover, the gate assembly of the present invention is provided with a door or first element slidable on the frame along a predetermined path of travel extending across the discharge opening. Unlike other known railroad car discharge gates, however, the present invention allows for either of two interchangeable modular components or elements to be easily and readily mounted on the frame for sliding movement along a predetermined path of travel beneath the door and across the discharge opening. One modular element is configured as an open top pan assembly including a pneumatic port allowing for pneumatic discharge of materials. The other modular component of the present invention is preferably configured as a flat plate for inhibiting debris from contaminating an underside of the gate and unloading attachment areas. Accordingly, a primary object of this invention is to provide a gate assembly specifically designed to allow for either pneumatic and/or gravitational discharge or gravitational discharge only of materials therethrough.

A unique drive mechanism forms part of the gate assembly of the present invention. According to the present invention, the drive mechanism is selectively engagable with and capable of selectively moving either the door or the modular element arranged on the gate assembly in combination with the door toward an open position and relative to the frame of the gate assembly. As is conventional, the drive mechanism includes an operating shaft assembly supported on the frame for rotation about a fixed axis.

The drive mechanism of the present invention further includes a rack and pinion assembly arranged in combination with the operating shaft assembly. The rack and pinion assembly includes a pair of laterally spaced pinions arranged on and rotatable with the operating shaft assembly. The rack and pinion assembly further includes a pair of laterally spaced racks or toothed tracks arranged in intermeshing relation relative to the pinions. Each of the racks, are carried on the frame of the gate assembly preferably on opposed sides of the door and in slidable relation relative to the door and either of the interchangeable modular components. In a preferred form, the racks are spaced from the frame so as to reduce the coefficient of friction therebetween. In a most preferred form, ultra-high molecular weight polyethylene is disposed between the frame of the gate assembly and each of the racks to promote sliding movements of the racks relative to the frame of the gate assembly.

In a preferred form, the drive mechanism further includes an apparatus arranged inoperative combination with the rack and pinion assembly for selectively coupling either the door or the modular component or both to the drive mechanism. The apparatus includes a control rod preferably mounted for endwise movement and having an actuator arranged thereon for operably engaging either the door or the modular component arranged on the gate assembly. In a preferred form, the actuator is positioned in the path of movement of either the door or the modular component arranged in combination with the door such that when the drive mechanism is operated, either the door or modular component will be moved toward an open position in response to rotation of the operating shaft. Alternatively, in a most preferred form, the rack and pinion assembly is locked thereby inhibiting rotation of the operating shaft assembly, thus, preventing movement of either the door or the modular element arranged in combination with the door on the gate assembly.

Moreover, the apparatus of the drive mechanism is preferably provided with a detent mechanism for releasably holding the actuator in a selected position to operably engage either the door or the modular component arranged in combination on the gate assembly. The apparatus of the drive mechanism furthermore preferably includes a spring for resiliently urging the control rod and the actuator carried thereby toward a predetermined position. In a preferred form, cam structure is arranged in combination with the apparatus for automatically positioning the control rod and thereby the actuator relative to the frame of the gate assembly when the apparatus is positioned adjacent an end wall of the frame of the gate assembly.

Another salient feature of the present invention involves providing a lost motion connection the drive mechanism and the door of the gate assembly. Rotation of the operating shaft assembly initially results in sliding movement of only the racks without corresponding linear movement of the door. Notably, only the racks slidably move relative to the frame and the door during the collapse of the lost motion connection. Because only the racks move, the operating shaft assembly will have a predetermined range of free rotation. Upon collapse of the lost motion connection, a relatively high impactual opening force will be applied to the door thereby enhancing opening of the door. Upon collapse of the lost motion continued rotation of the operating shaft assembly will effect substantially simultaneous linear movement of the rack and door relative to the frame. Moreover, and besides offering a relatively high impactual opening force to the door, the lost motion connection between the door and the operating shaft maintains the door and the other modular element arranged in combination with the door in timed relation relative to each other.

In a preferred form, a tamper seal can be provided in combination with the operating shaft assembly. The purpose of the tamper seal is to provide a visual indication of whether the operating shaft assembly has been operated to move either the door or that modular component arranged on the gate assembly in combination with the door toward an open position.

The seal structure is preferably comprised of an elongated and hollow elastomeric member configured for energization regardless of the direction of movement of either the door or the modular component associated with the door. The elastomeric member of the seal structure has a first radial surface arranged in tangential engaging relation relative to a flat surface on the door or the modular component associated with the door thereby allowing the door or the modular component to move in either linear direction while maintaining a sealing engagement therewith. The radial surface preferably has an elongated rib projecting therefrom and extending therealong to enhance the sealing ability of the seal structure relative to either the door or the modular component associated with the door.

In a most preferred form, the elastomeric member of the seal structure has a centralized mounting portion with an aperture or opening defining an axis extending generally parallel to the path of travel of the door. The first radial surface on the elastomeric member is disposed to one side of the axis. In an alternative form, the elastomeric member has a second radial surface disposed on an opposite side of the seal structure. The second radial surface is disposed generally tangential to a flat surface on the door or the modular component associated with the door thereby allowing the door or the modular component to move in either linear direction while maintaining a sealing engagement therewith. As will be appreciated, two sealing surfaces allows the seal to be compressed between the door and the modular component thereby acting as a compression/wiper seal or allowing for reversal of the seal structure thereby prolonging the useful life thereof.

In a preferred form, the frame of the gate assembly furthermore includes wall structure or skirt arranged in surrounding relation relative to and depending from the discharge opening of the frame to define a discharge plenum through which material passes. To facilitate connection of a discharge apparatus thereto, the lower end of the depending walled structure or skirt is configured with flanges which operate in a conventional manner with an inlet to the unloading apparatus thereby enhancing transference of particulate materials through the gate assembly and into the discharge apparatus. As will be appreciated, when the modular component arranged in combination with the door on the gate assembly is configured as a flat or sanitary plate, such plate inhibits debris from contaminating the underside of the door and the plenum chamber.

When the gate assembly of the present invention is mounted to a hopper car, it allows the gate assembly to be readily and easily conditioned for either gravitational or pneumatic discharge of food grade materials from an enclosure on the car wherein the food grade materials are held and transported. Either of two modular components are fitted to the gate assembly and move along rails projecting outwardly from the frame. During operation, the apparatus of the drive mechanism is suitably conditioned to properly position the actuator of the apparatus in the path of travel of movable elements on the gate assembly thereby effecting their movement when the operating shaft assembly is rotated. The lost motion connection of the drive mechanism allows a relatively high impactual force to be imparted to the door during the initial opening thereof. Moreover, the seal structure preferably forming a part of the present invention inhibits debris from passing between the elements and the frame thereby protecting the food grade commodity from contamination.

These and other objects, aims and advantages of the present invention will be readily and quickly appreciated from the following detailed description, appended claims, and drawings.

DETAILED DESCRIPTION OF THE DRAWINGS

FIG. 14 is a schematic representation of the relative position of various components of the apparatus of the drive mechanism and door when the apparatus is arranged in different conditions;

FIG. 19 is a sectional view taken along line 19—19 of FIG. 2;

FIG. 20 is an enlarged longitudinal sectional view of a seal used in combination with the present invention.

DETAILED DESCRIPTION OF THE PRESENT INVENTION

Figure 1:
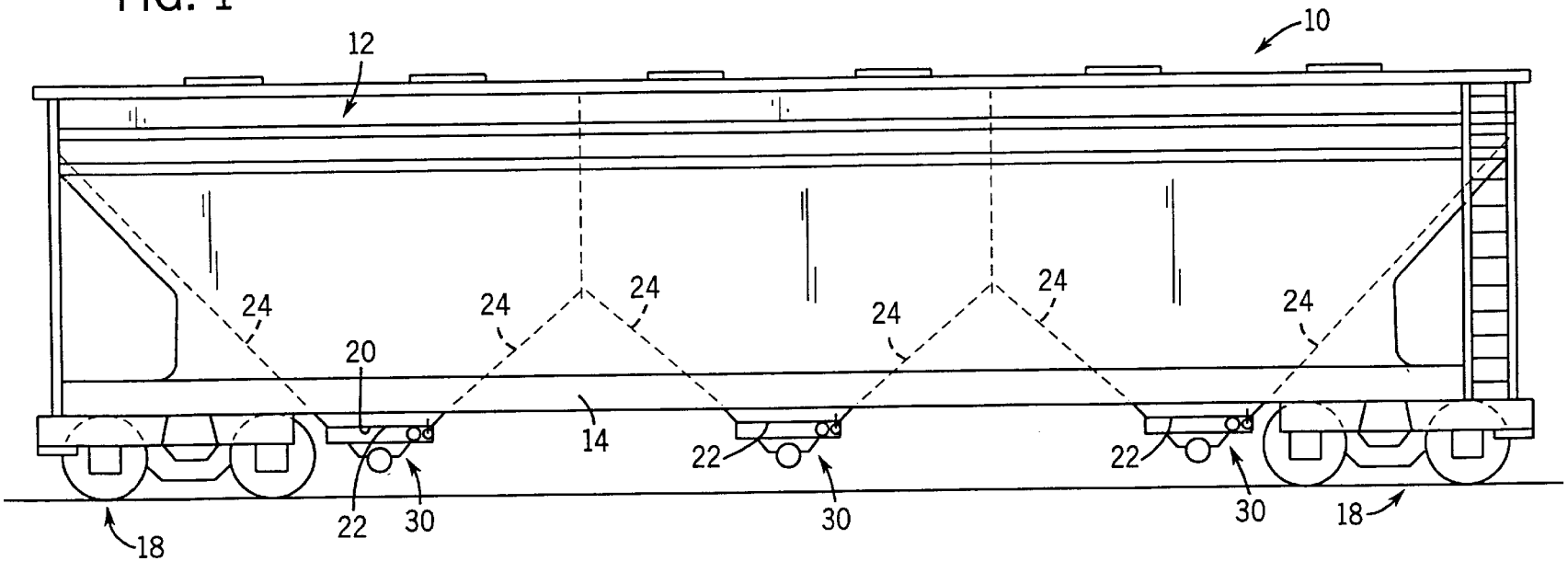
FIG. 1 is a side elevational view of a railroad hopper car equipped with a gate assembly embodying principals of the present invention.
Figure 1A:
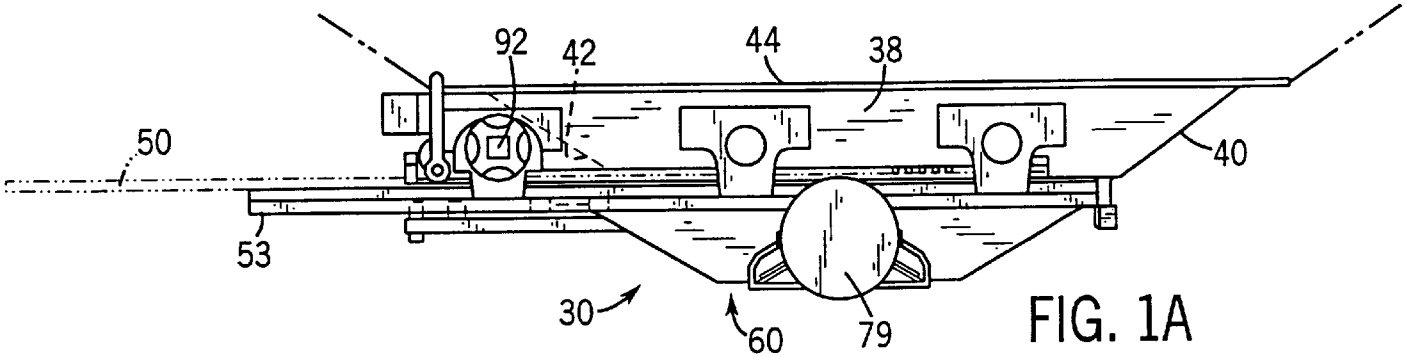
FIG. 1A is an enlarged side elevational view of a gate assembly according to the present invention.

While the present invention is susceptible of embodiment in various forms, there is shown in the drawings and will hereinafter be described in detail a preferred embodiment of the invention with the understanding the present disclosure is to be considered as setting forth an exemplification of the invention which is not intended to limit the invention to the specific embodiment illustrated.

Referring now to the drawings, wherein like reference numerals indicate like parts throughout the several views, a railroad hopper car, equipped with a gate assembly according to the present invention, is illustrated in FIG. 1. The railroad hopper car, generally designated by reference numeral 10, includes a multiwalled enclosure 12 for storing and transporting commodity therewithin. As is known in the art, the multiwalled enclosure 12 is supported on an underframe 14. The underframe 14 extends generally the length of the car 10. As is typical, the underframe 14 is supported toward opposite ends thereof by conventional wheeled trucks, generally designated by reference numeral 18.

As illustrated, a bottom 20 of the enclosure 12 is provided with a plurality of openings 22 for allowing the commodity to be discharged from the enclosure 12. As will be appreciated, more or fewer openings than that shown can be readily provided without detracting or departing from the true spirit and scope of the present invention. As shown, the enclosure 12 of hopper car 10 includes a plurality of slope sheets 24 funneling downwardly toward each opening 22 in the bottom 20 of the hopper car 10 to promote the discharge of commodity therefrom.

Figure 3:
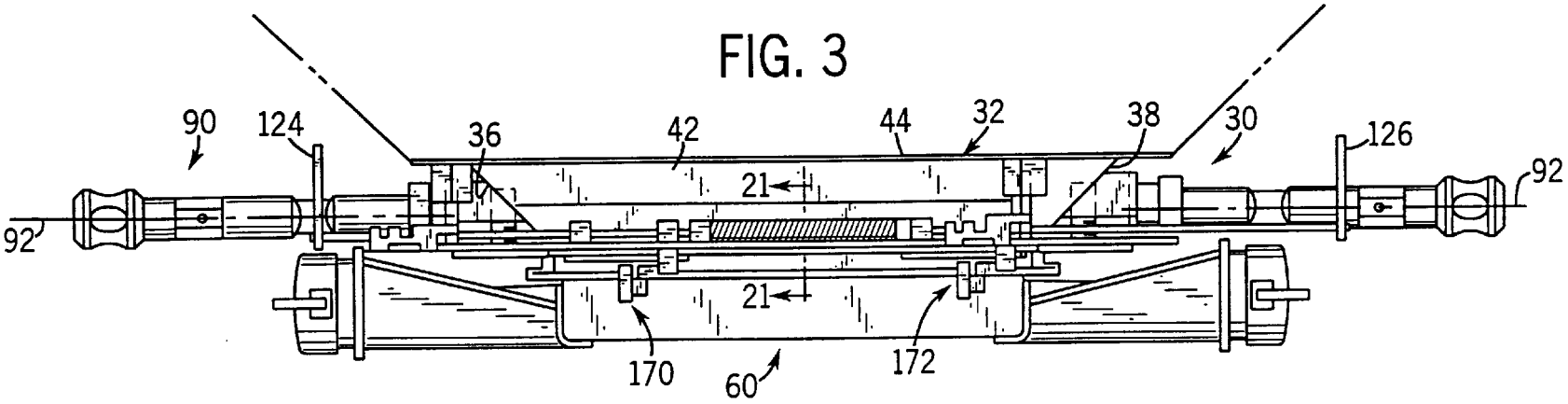
FIG. 3 is an end elevational view of the gate assembly illustrated in FIG. 2.
Figure 2:
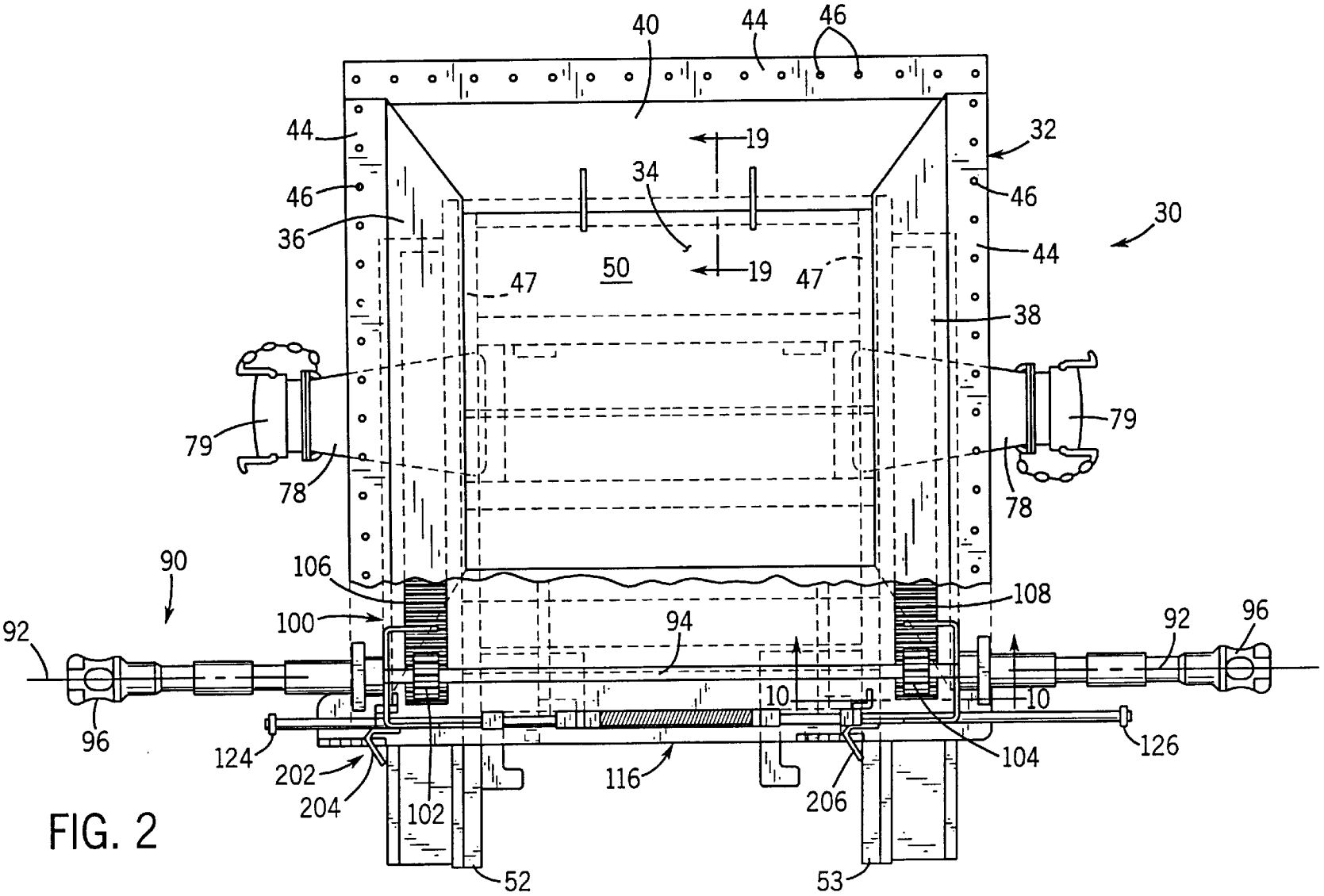
FIG. 2 is a top plan view of a gate assembly according, to the present invention, with parts broken away to illustrate particular features of the present invention.

A gate assembly, generally designated by reference numeral 30, is shown arranged in combination with each opening 22 along the bottom 20 of the hopper car 10. Since the gate assemblies 30 arranged along the bottom 20 of the car 10 are substantially identical relative to each other, only one gate assembly will be described in detail. As illustrated in FIGS. 2 and 3, each gate assembly 30 includes a rigid frame 32 defining a discharge opening 34. The frame 32 of gate assembly 30 is preferably fabricated from FDA approved materials in all commodity contact areas to allow the hopper car 10 to hold and transport food grade materials and eliminate lining requirements. Notably, when the gate assembly 30 is attached or otherwise connected to the walled enclosure 12, the discharge opening 34 defined by the frame 32 is arranged in registry with a respective opening 22 (FIG. 1) in the walled enclosure 12 of the hopper car 10.

As shown, frame 32 includes opposed and generally parallel side walls 36, 38 extending lengthwise of the hopper car and opposed end walls 40 and 42 extending transversely across the hopper car. In the illustrated form of the invention, the disposition of the side walls 36, 38 and end walls 40, 42 is such that a trapezoidal or rectangular shape is provided for the discharge opening 34.

As shown in FIGS. 1A, 2, 3 and 8, each side wall 36, 38 and end wall 40, 42 has a mounting flange 44 formed toward an upper end thereof. In a manner well known in the art, the flanges 44, toward the upper end of the walls 36 through 42, are configured to mate with respective portions of the hopper car to facilitate attachment of the gate assembly 30 to the hopper car. In one form, the flanges 44 define spaced holes 46 (FIGS. 2 and 8) allowing for passage of suitable fasteners, such as threaded bolts, therethrough.

The gate assembly 30 of the present invention is furthermore provided with a door or first element 50 mounted on the frame 32 for selectively closing the discharge opening 34 defined by frame 32. The door 50 is mounted for sliding movement along a predetermined path of travel. In the illustrated form of the invention, and in a closed position (shown in solid lines in FIG. 2), the door 50 extends across the discharge opening 34 defined by the frame 32. As will be appreciated, however, door 50 is movable to an open position (shown in phantom lines in FIG. 1A) to allow commodity to pass from the gate assembly 30 through the discharge opening 34. Frame 32 is preferably provided with parallel frame extensions or supports 52 and 53 (FIG. 2) extending lengthwise of the hopper car and away from the end wall 42 of frame 32. The frame extensions or supports 52, 53 support peripheral and opposed sides of the door 50 when the door 50 is moved to and open position relative to the frame 32.

Figure 4:
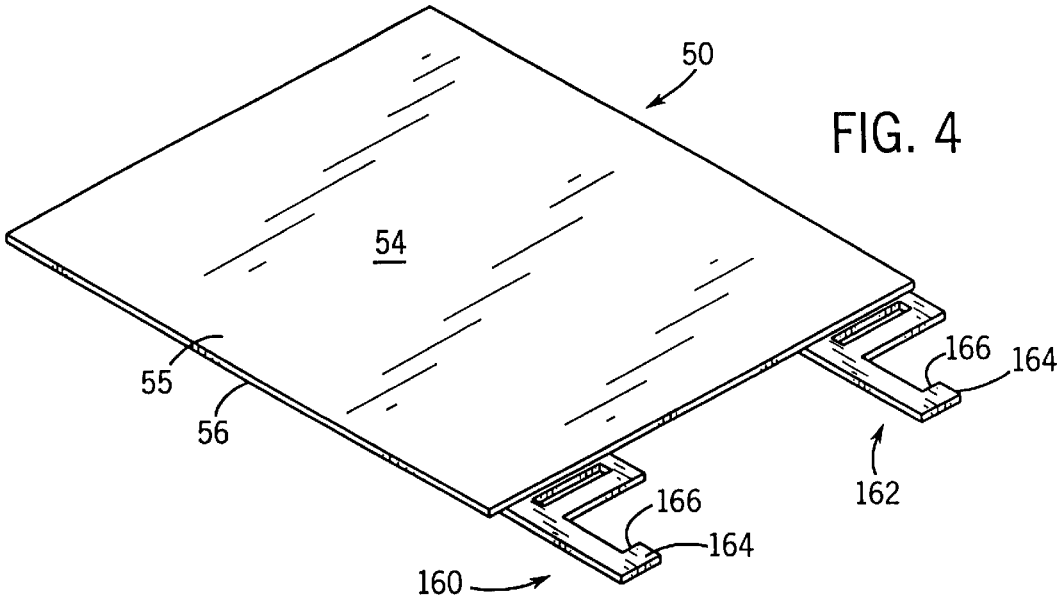
FIG. 4 is a perspective view of a door element used in combination with the gate assembly of the present invention.

As shown in FIG. 4, the door 50 is preferably configured as a rigid flat plate 54 including upper and lower surfaces 55 and 56, respectively. In the illustrated form of the invention, door 50 has a generally rectangular configuration. To permit the gate assembly 30 to be used in combination with a food grade commodity, the door 50 is preferably fabricated from an FDA approved material such as stainless steel.

Figure 9:
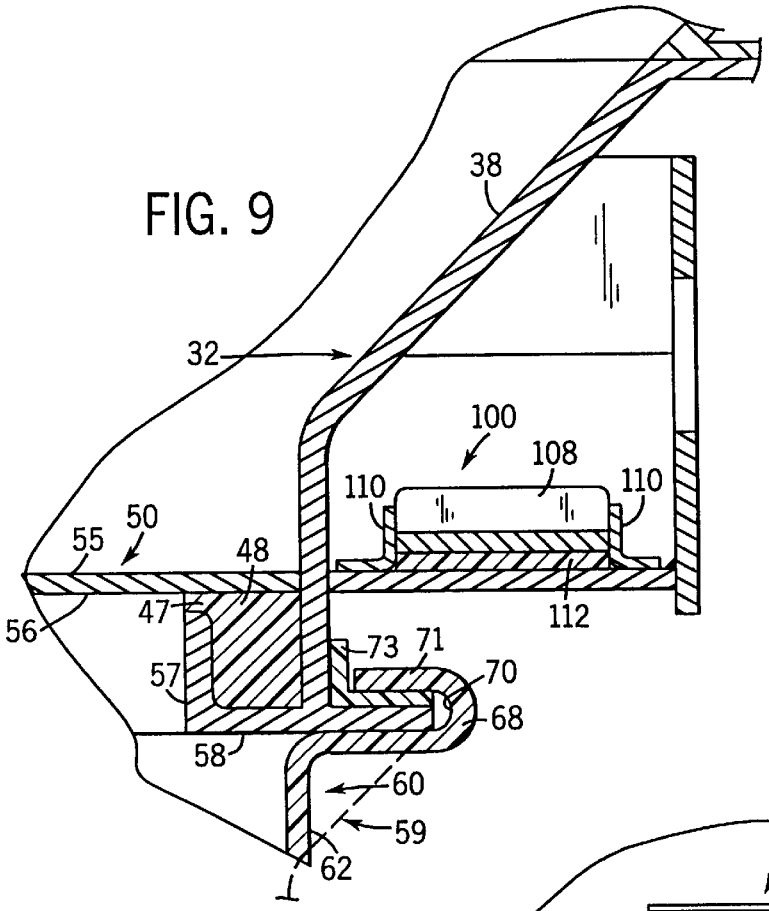
FIG. 9 is a sectional view taken along line 9—9 of FIG. 8.
Figure 10:
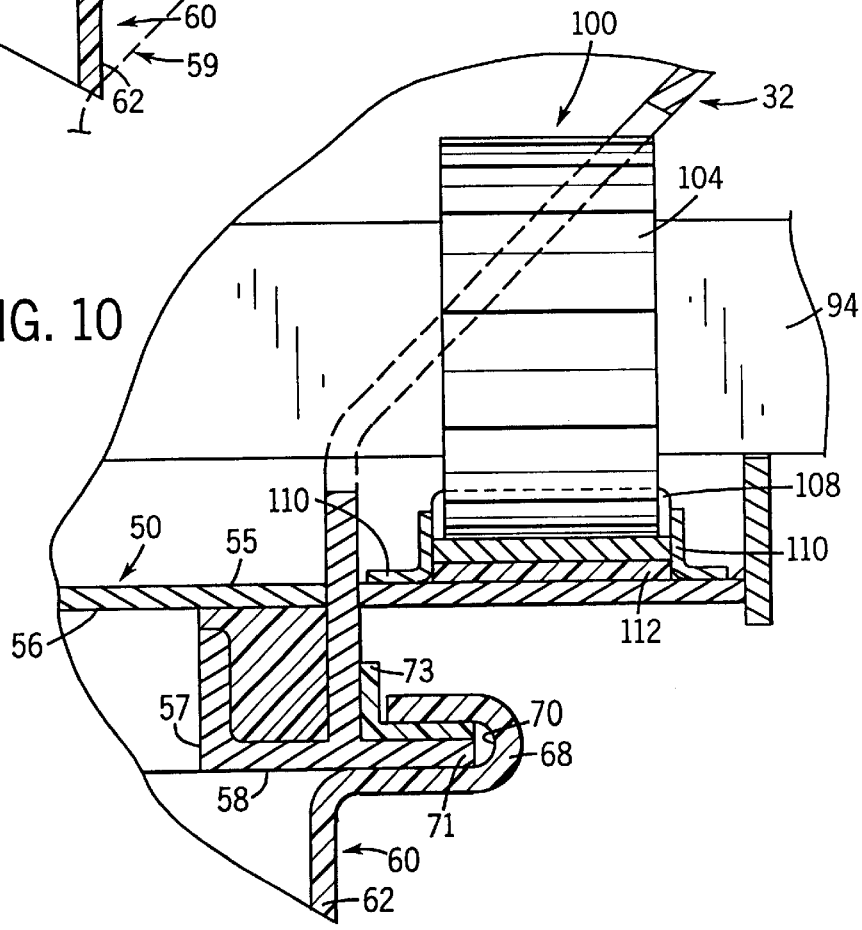
FIG. 10 is a sectional view taken along line 10—10 of FIG. 2.

The side walls 36, 38 and end walls 40, 42 of the gate assembly 32 are each provided with a ledge 47 which underlies and supports the door 50. In a most preferred form, and as shown in FIGS. 9 and 10, and to prevent galling of stainless steel in contact with stainless steel, an upper door contacting surface on each ledge 47 is covered with ultra-high molecular weight polyethylene 48 material. The provision of the material 48 between the ledge 47 and the undersurface 56 of the door 50 acts as a shield between the lower or underside 56 of the door 50 and the frame 32 of the gate assembly 30 while also serving to reduce the coefficient of friction therebetween when the door 50 is slidably moved relative to the frame 32.

The side walls 36, 38 and end walls 40, 42 of the frame 32 of gate assembly 30 depend from the discharge opening 34 to define a plenum chamber 57 (FIGS. 9 and 10). As is conventional, the lower ends of walls 36 through 42 of gate assembly 30 have a flange-like configuration 58 to permit a conventional discharge apparatus 59 (schematically illustrated in phantom lines in FIG. 9) to be coupled or otherwise secured thereto. Suffice it to say, the discharge apparatus 59 (also commonly referred to as an air sled) maybe of the type disclosed in one or more of the following U.S. Pat. Nos.: 2,376,814; 2,517,837; 2,527,455, 2,527,466; 2,589,968; 2,657,100; 2,675,274; 2,681,748, 2,789,739. Alternatively, the discharge apparatus 59 may be a simple compression boot or chamber that draws particulate matter or commodity toward to a storage reservoir.

Gate assembly 30 furthermore includes either of two modular elements 60, 80 to be arranged in operable association with the door 50. Either element 60, 80 is configured to be interchangeably and slidably arranged on the frame 32 of gate assembly 30 in vertically spaced relation relative to door 50. In the illustrated embodiment of the invention, modular element 60 is configured as an open top pan assembly and element 80 is preferably configured as a sanitary plate or cover. Both interchangeable elements 60 and 80 are preferably fabricated from FDA approved materials such as stainless steel or the like whereby permitting the gate assembly 30 to be used in conjunction with food grade commodities.

Figure 5:
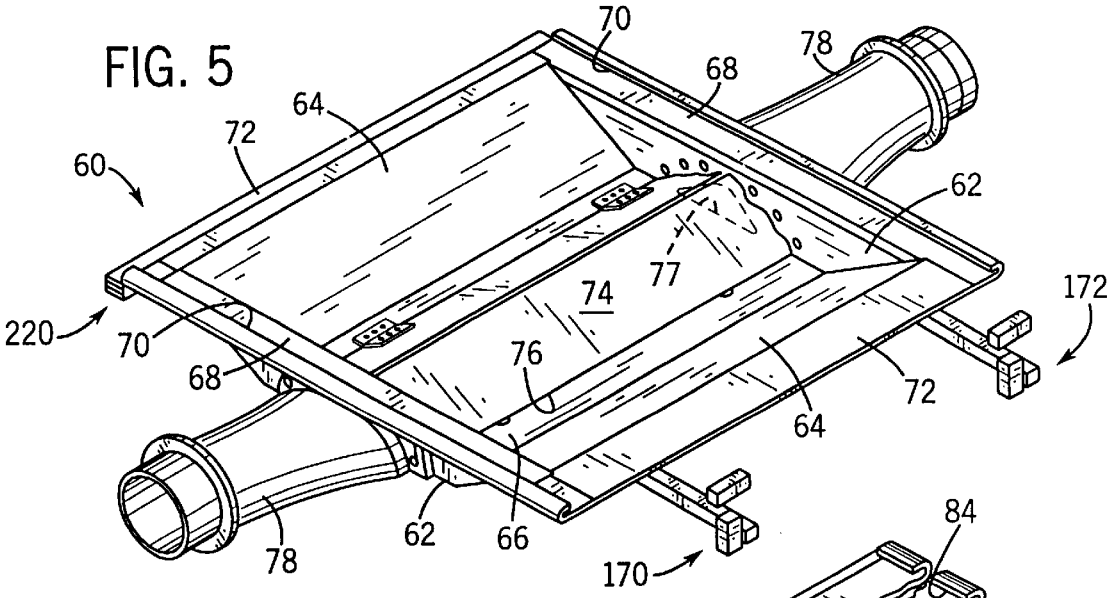
FIG. 5 is a perspective view of an open top pan modular element usable in combination with the gate assembly of the present invention.

The open top pan assembly 60 is used in combination with the gate assembly 30 for pneumatically discharging lading from the enclosure 12 (FIG. 1) of the hopper car 10. As shown in FIG. 5, the open top pan assembly 60 preferably comprises two generally vertical and laterally spaced side walls 62, two slanting end walls 64 rigidly joined to the side walls 62, and a generally flat bottom 66. As shown in FIG. 9, the upper edges of the side walls 62 are bent outwardly to form flanges 68 which terminate in open sided channels 70. The open sided channels 70 are arranged in combination with rails 71 projecting outwardly from and extending parallel to the side walls 36, 38 of the frame 32 of the gate assembly 30 for allowing fore-and-aft sliding movement of element 60 along a predetermined path of travel relative to frame 32 between open and closed positions beneath the door 50.

Figure 21:
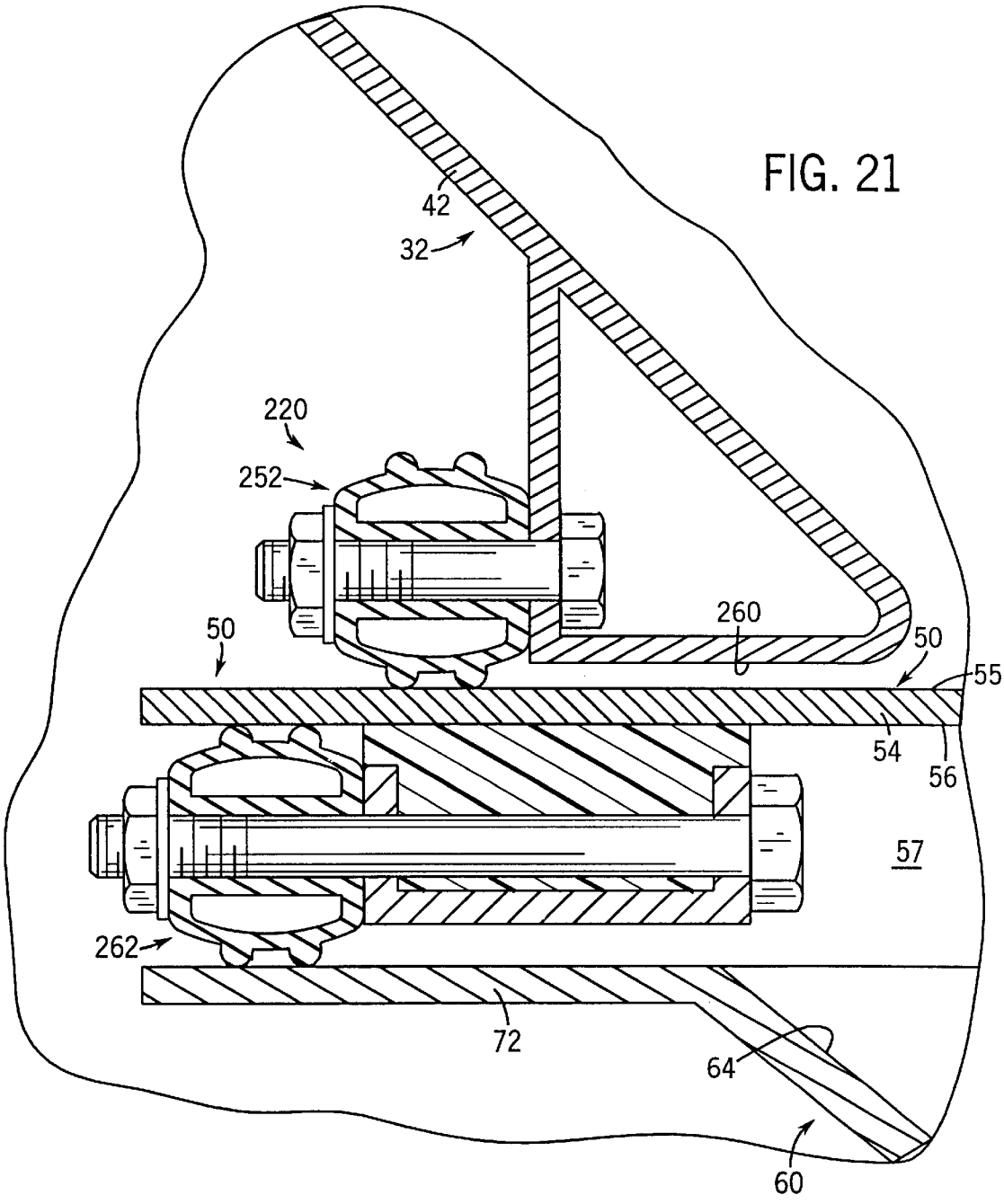
FIG. 21 is a sectional view taken along line 21—21 of FIG. 3.

To enhance sliding movement of the pan assembly 60 relative to the frame 32 of the gate assembly 30, and to effectively seal the sides of the pan assembly 60 to the frame 32 thereby inhibiting passage of debris therepast, ultra-high molecular weight polyethylene material 73 is preferably disposed between the rails 71 and the open sided channels 70 on the pan assembly 60. In the illustrated embodiment, and as shown in FIG. 5, the upper edges of the end walls 64 are likewise bent to project in a fore-and-aft direction to form flanges 72. In a preferred form, the flanges 72 projecting fore-and-aft from the end walls 64 of the pan assembly 60 are generally coplanar with the flanges 68 and extend generally parallel to and in vertically spaced relationship with the flanged configuration 56 at the bottom of the walls 36 through 42 on the frame 32 of the gate assembly 30 (FIGS. 19 and 21).

Returning to FIG. 5, a conduit system, within the open top pan assembly 60, is provided for the pneumatic discharge of commodity from the enclosure 12. As shown, the conduit system is in the form of a centrally disposed inverted and generally V-shape hood 74 which, in a preferred form of the invention, is hingedly connected to the flat bottom 66 of the pan assembly 60 between the side walls 62 and above the flat bottom 66 so as to define, with the bottom 66, a conduit extending transversely across the pan assembly 60 between the side walls 62. An elongated opening or passage 76 is provided between a lower edge of the hood 74 and the bottom 66 of the pan assembly 60 to provide for passage of the commodity from the pan assembly 60 into the conduit whereafter low pressure air will draw or carry the commodity in a conventional manner for discharge of same from the pan assembly 60. As will be appreciated by those skilled in the art, each side wall 62 of the pan assembly defines an opening 77 which cooperates with the conduit for allowing passage of commodity from the pan assembly 60. A conventional external conduit 78 is exteriorly connected to each side wall 62 of the pan assembly in surrounding relation relative to the opening or passage 77. An outer end of the external conduit 78 is adapted to be connected to a conventional pneumatic system in a conventional way. Alternatively, the free end of the external conduit 78 is provided with a conventional cap 79 (FIG. 7) releasably secured thereon in a well known manner to seal the open top pan assembly 60 when the hopper car 10 (FIG. 1) is in transport.

Figure 6:
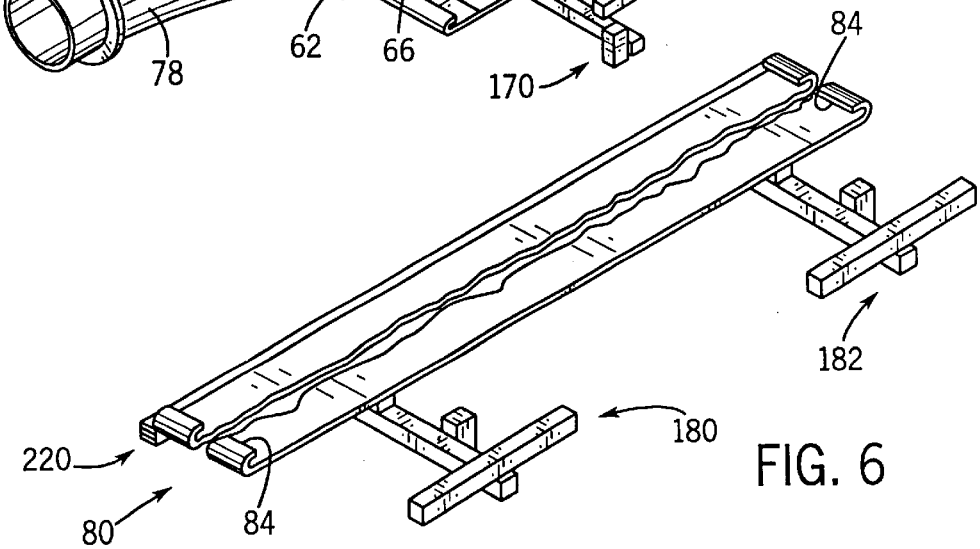
FIG. 6 is a partial perspective view of a modular plate element usable in combination with the gate assembly of the present invention.

The second interchangeable or modular element 80 has a generally flat planar configuration between opposed side edges thereof Like modular element 60, and as illustrated in FIG. 6, the flat sanitary plate 80 is provided with two open sided channels 84 which operate in combination with the rails 71 on the frame 32 of the gate assembly for allowing the modular element 80 to slidably move in a fore-and -aft direction along a predetermined path of travel relative to the frame 32 between open and closed positions beneath the door 50. As will be described in further detail below, the purpose of the modular element 80 is to inhibit debris and the like from contaminating the underside 56 of the door 50 and the plenum chamber 57 during transport of the hopper car 10. Notably, the ultra-high molecular weight material 73 is likewise used between the rails 71 and the channels 84 on the second element or plate 80 to seal the sides of the plate 80 and frame 32 against debris moving therebetween.

Figure 7:
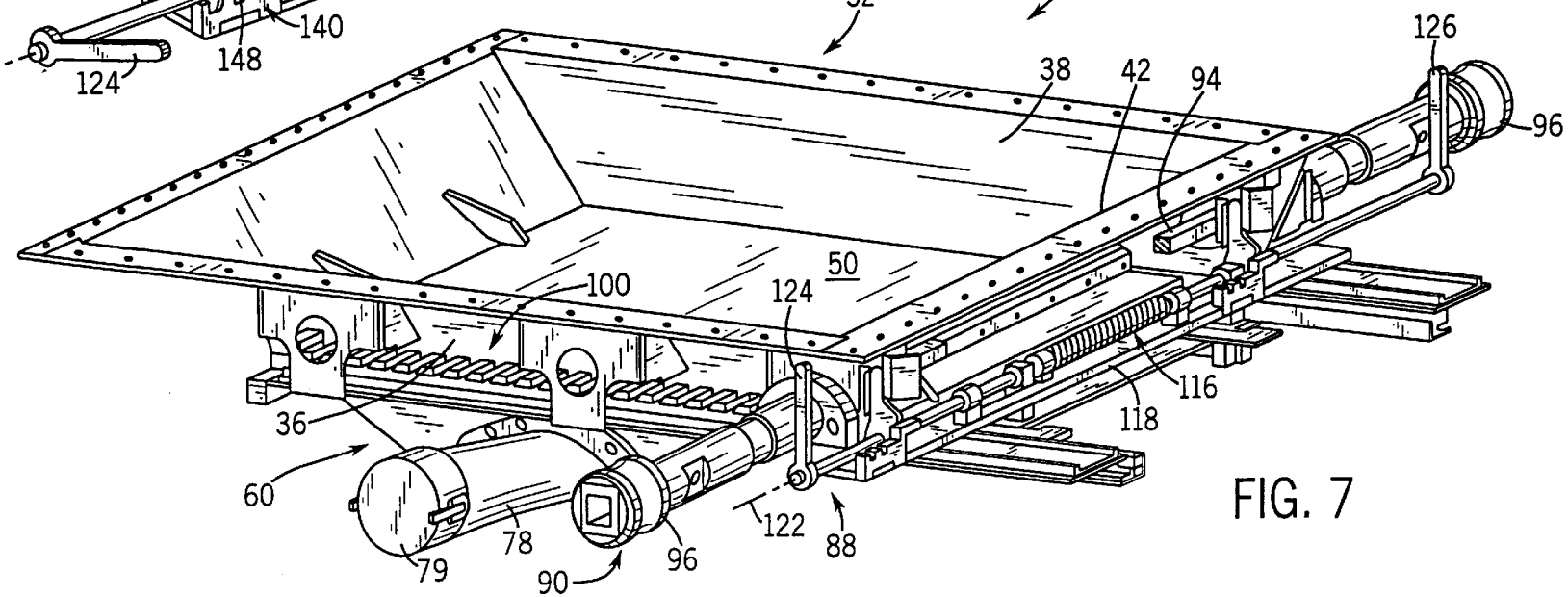
FIG. 7 is a perspective view of the gate assembly of the present invention illustrating the door in a closed position and the modular pan element arranged in association with the gate assembly.

Turning now to FIG. 7, gate assembly 30 further includes an actuating or drive mechanism 88 carried on the frame 32. One of the many salient features of the present invention relates to the ability of the drive mechanism 88 to be selectively engaged with and capable of moving either the door 50 or either of the two modular elements 60, 80 arranged in association with the door 50 relative to the frame 32 and toward an open position. In the illustrated embodiment, the drive mechanism 88 is designed to linearly displace the door 50 and the second modular element 60, 80 arranged on the gate assembly 30 in association with the door 50 different linear distances. In the illustrated embodiment, drive mechanism 88 is designed to linearly displace the second modular element 60, 80 arranged on the gate assembly 32 in combination with the door 50 a greater linear distance than the door 50 linearly moves. As illustrated in FIG. 2, drive mechanism 88 preferably includes an operating shaft assembly 90 carried on the frame 32 for rotation about a fixed axis 92. The operating shaft assembly 90 includes an elongated operating shaft 94 rotatably mounted for fixed rotation about axis 92 and capstans or operating handles 96 affixed to opposite ends of shaft 94.

Drive mechanism 88 further includes a rack and pinion assembly 100 arranged in operative combination with the operating shaft assembly 90. As illustrated in FIG. 2, the rack and pinion assembly 100 preferably includes a pair of laterally spaced pinions 102 and 104 mounted on and for rotation with the operating shaft 94 of the operating shaft assembly 90. The pinions 102 and 104 are arranged in intermeshing relation with a pair of elongated racks or toothed tracks 106 and 108.

As illustrated in FIG. 2, the toothed tracks 106, 108 are carried on the frame 32 of the gate assembly 30 and extend generally parallel to opposed sides of the door 50. Notably, the elongated racks 106, 108 are mounted on the frame 32 in laterally outward spaced relation from opposed side edges of the door 50 for endwise sliding movement relative to the frame 32, the door 50, and either of the two modular elements 60, 80 mounted on the frame 32 in operative association with the door 50. Lateral or sideways movement of the racks 106, 108 is limited by guides 110 (FIGS. 8, 9 and 10) affixed to the frame 32 on opposite lateral sides of each rack 106, 108.

Figure 8:
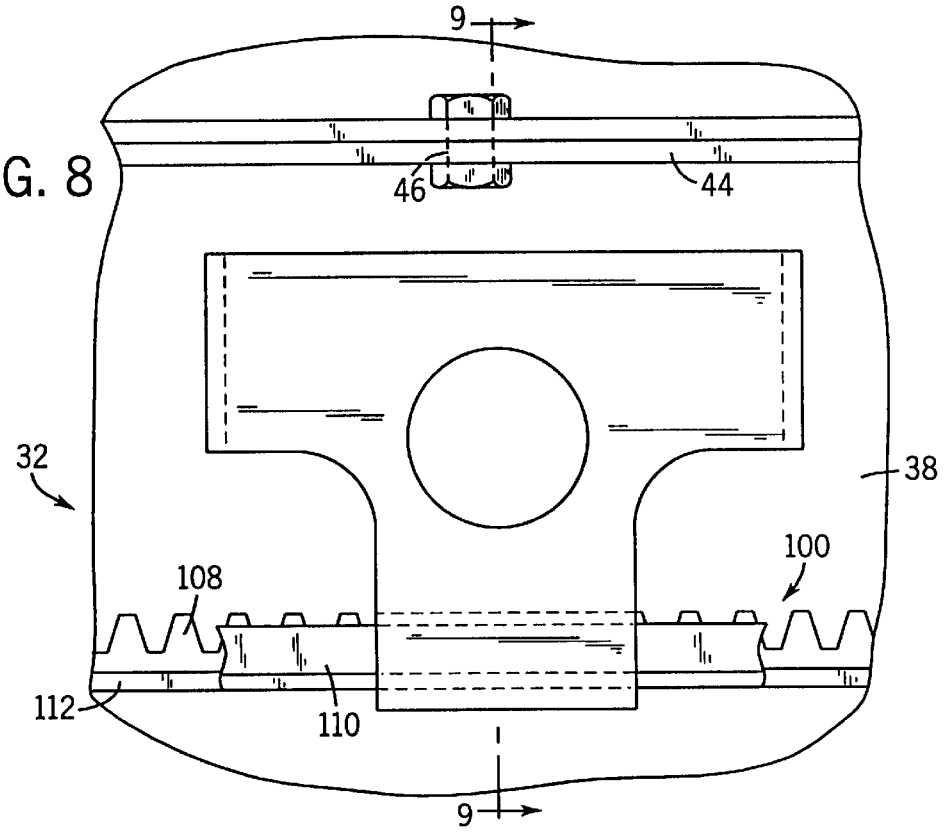
FIG. 8 is an enlarged fragmentary side elevational view of the gate assembly.

As illustrated in FIGS. 8, 9 and 10, each rack 106, 108 of the rack and pinion assembly 100 is vertically spaced from the frame 32 of the gate assembly 30 on which it is mounted and relative to which it slidably moves. Because the racks 106, 108 are separated from the frame 32, the coefficient of friction between the racks 106, 108 and frame 32 is substantially reduced. Several alternative devices could be used to separate the racks 106, 108 from the frame 32 of the gate assembly 30. In the illustrated embodiment, ultra-high molecular weight polyethylene material 12 is entrapped between the racks 106, 108 and the frame 32 of the gate assembly 30 thereby reducing the coefficient of friction therebetween, thus, enhancing sliding movement of the racks 106, 108 relative to the frame 32.

Figure 11B:
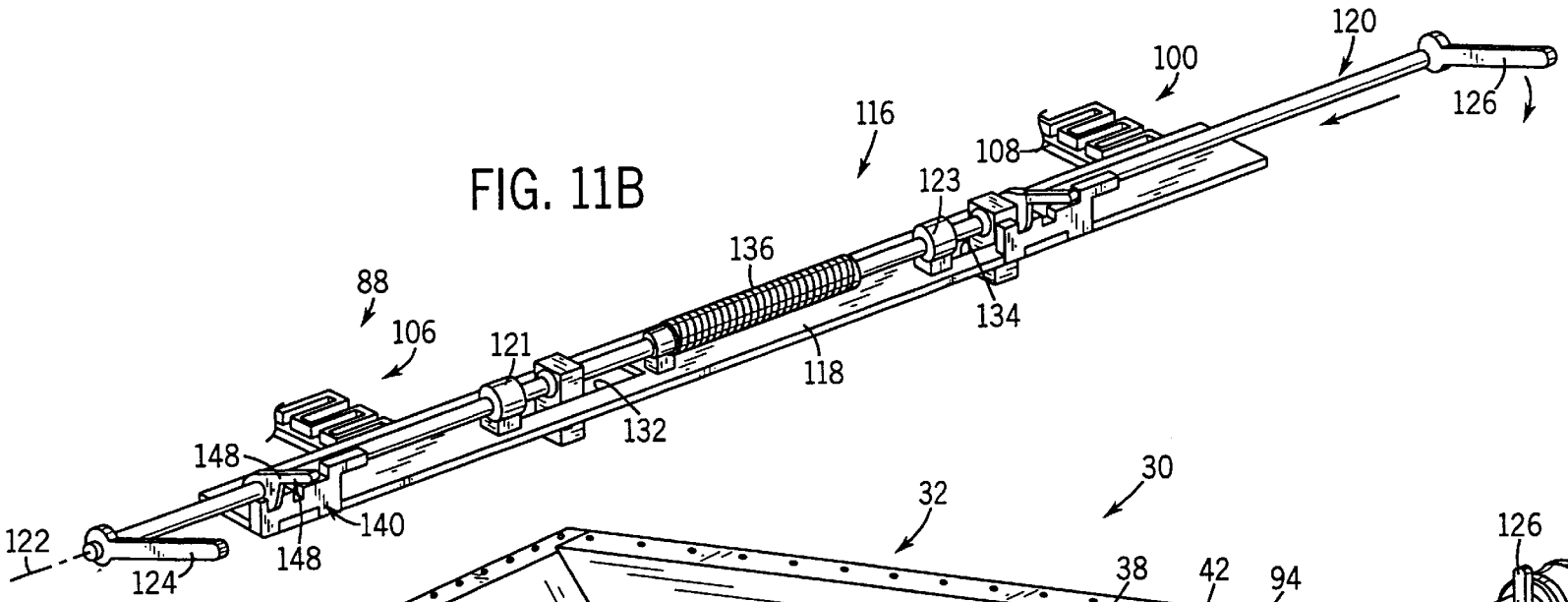
FIG. 11B is a perspective view similar to FIG. 11 but illustrating the apparatus of the drive mechanism in a third condition.
Figures 11, 11A:
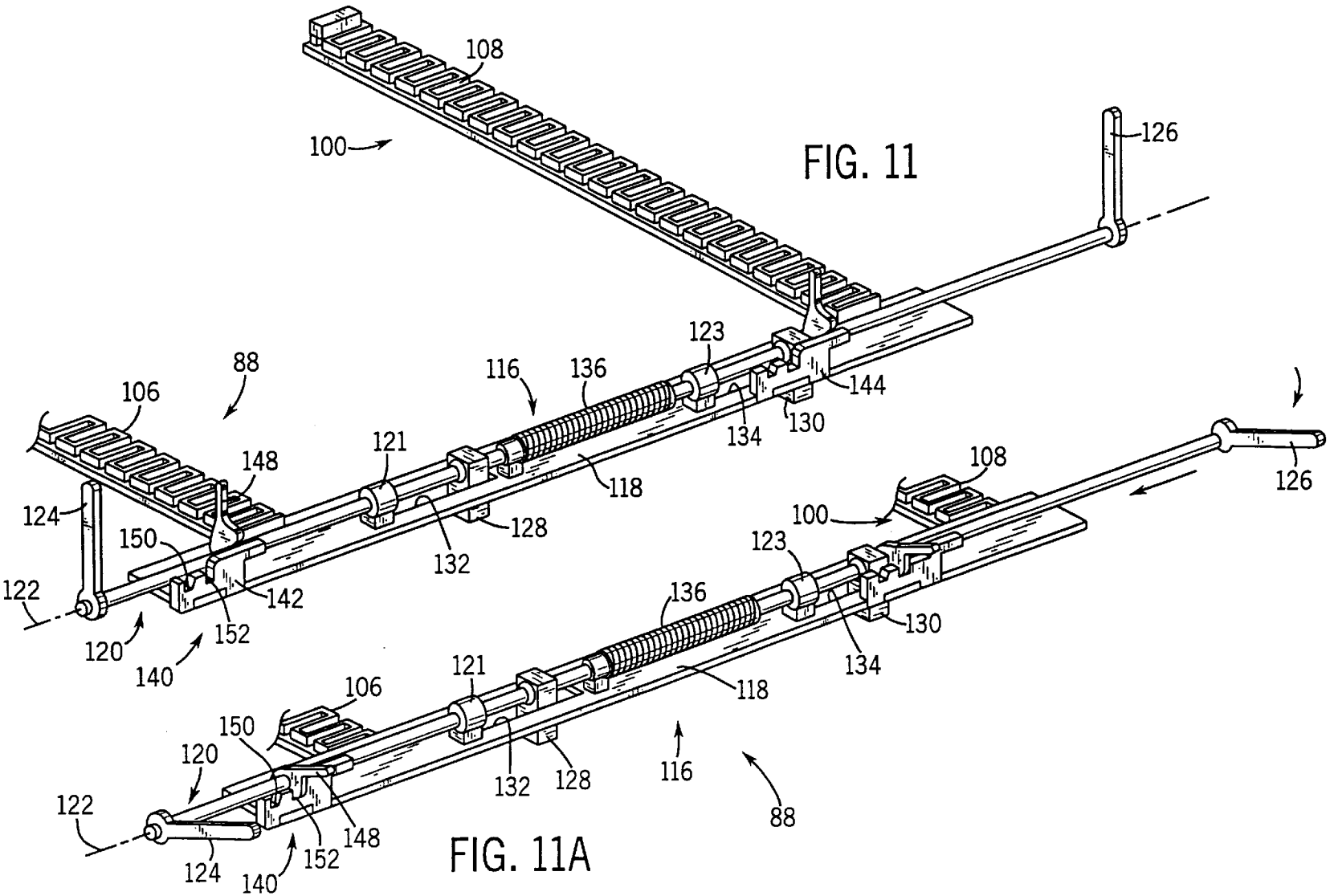
FIG. 11 is a perspective view of an apparatus forming part of a drive mechanism of the gate assembly of the present invention in a first condition.
FIG. 11A is a perspective view similar to FIG. 11 but illustrating the apparatus of the drive mechanism in a second condition.

The drive mechanism 88 of the gate assembly 30 further includes an apparatus 116 for selectively interconnecting the operating shaft assembly 90 to either the door 50 or the modular component 60, 80 arranged in combination on the gate assembly 30. Turning to FIG. 11, apparatus 116 is arranged in combination and moves with the racks 106, 108 of the rack and pinions assembly 100. As illustrated, apparatus 116 includes a laterally extending base 118 which spans the distance between and is rigidly joined to the free ends of the racks 106, 108 of the rack and pinion assembly 100. In the illustrated form of the invention, the apparatus 116 is manually operated. It is well within the spirit and scope of the present invention, however, and with slight redesign efforts, the indexing system or apparatus 116 can include a driver for replacing the manual efforts now contemplated for use in conjunction therewith.

As shown in FIG. 11, apparatus 116 includes a control rod 120 mounted on the base 118 preferably by a pair of laterally spaced supports 121 and 123 for generally linear displacement along an axis 122 extending generally parallel with the end wall 42 of the frame 32 (FIG. 7). As shown, the control rod 120 is preferably provided with handles 124 and 126 arranged toward opposite ends thereof for easy grasp by an operator and which readily allow the control rod 120 to be linearly positioned relative to the frame 32 and rotated about axis 122. In the illustrated form, the control rod 122 has a pair of laterally spaced actuators 128 and 130 arranged for conjoint linear displacement with but which are inhibited from rotating with the control rod 122. In the illustrated form, the actuators 128 and 130 move endwise within laterally elongated slots 132 and 134 defined by the base 118 of apparatus 116. For reasons discussed in detail hereinafter, the control rod 120 of apparatus 116 is resiliently biased relative to the frame 32 of the gate assembly 30. In the illustrated form, a spring 136 resiliently biases the control rod 120 and the actuators 128 and 130 carried thereon to the right, as seen in FIG. 11, and to a predetermined position or condition.

In a preferred form, apparatus 116 can be selectively conditioned in any of three positions or conditions. First, the apparatus 116 can be conditioned in a position (FIG. 11B) whereby actuation of the drive mechanism 90 will result in displacement of the door 50. Second, the apparatus 116 can be conditioned in a position (FIG. 11A) whereby actuation of the drive mechanism 90 will result in displacement of the second or modular element 60, 80 arranged on the gate assembly 30. Alternatively, the apparatus 16 can be conditioned in a position (FIG. 11) whereby the drive mechanism 90 is inhibited from imparting movement to and thereby locking both the 50 and the second element 60, 80 against displacement relative to the frame 32 of the gate assembly 30.

Preferably, apparatus 116 further includes a detent mechanism 140 for releasably holding the apparatus 116 in a selected condition. More specifically, the detent mechanism 140 serves to releasably hold the control rod 120 and, thus, the actuators 128 and 130 in a selected condition or position relative to the frame 32 of the gate assembly 30. As will be appreciated by those skilled in the art, the detent mechanism 140 can take a myriad of different forms from that shown without detracting or departing from the true spirit and scope of the invention. In the form illustrated in FIG. 11, the detent mechanism 140 preferably includes a pair of laterally spaced holders 142, 144.

Figure 12:
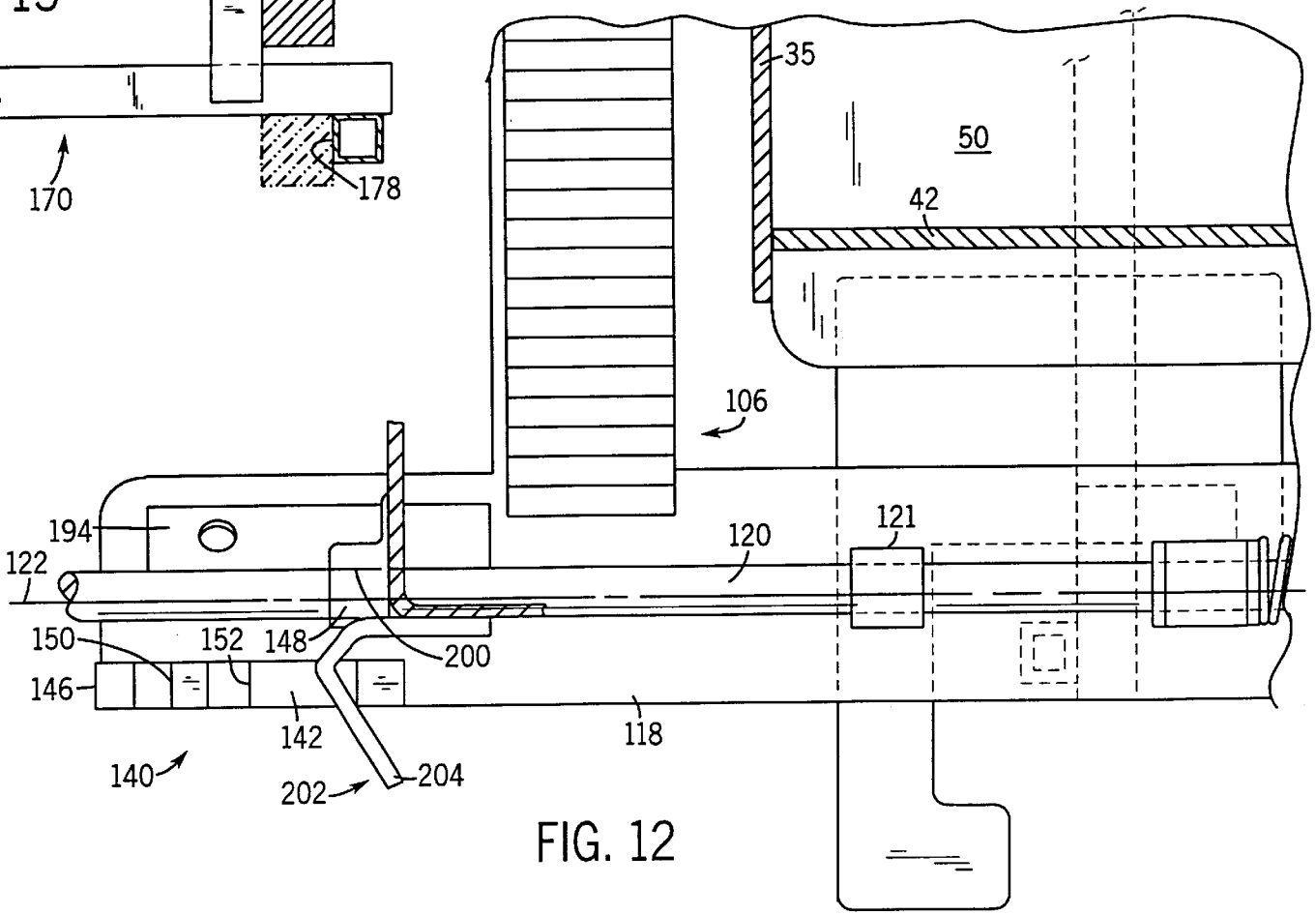
FIG. 12 is a fragmentary and enlarged top plan view of the apparatus of the drive mechanism illustrated in the first condition.
Figure 13:
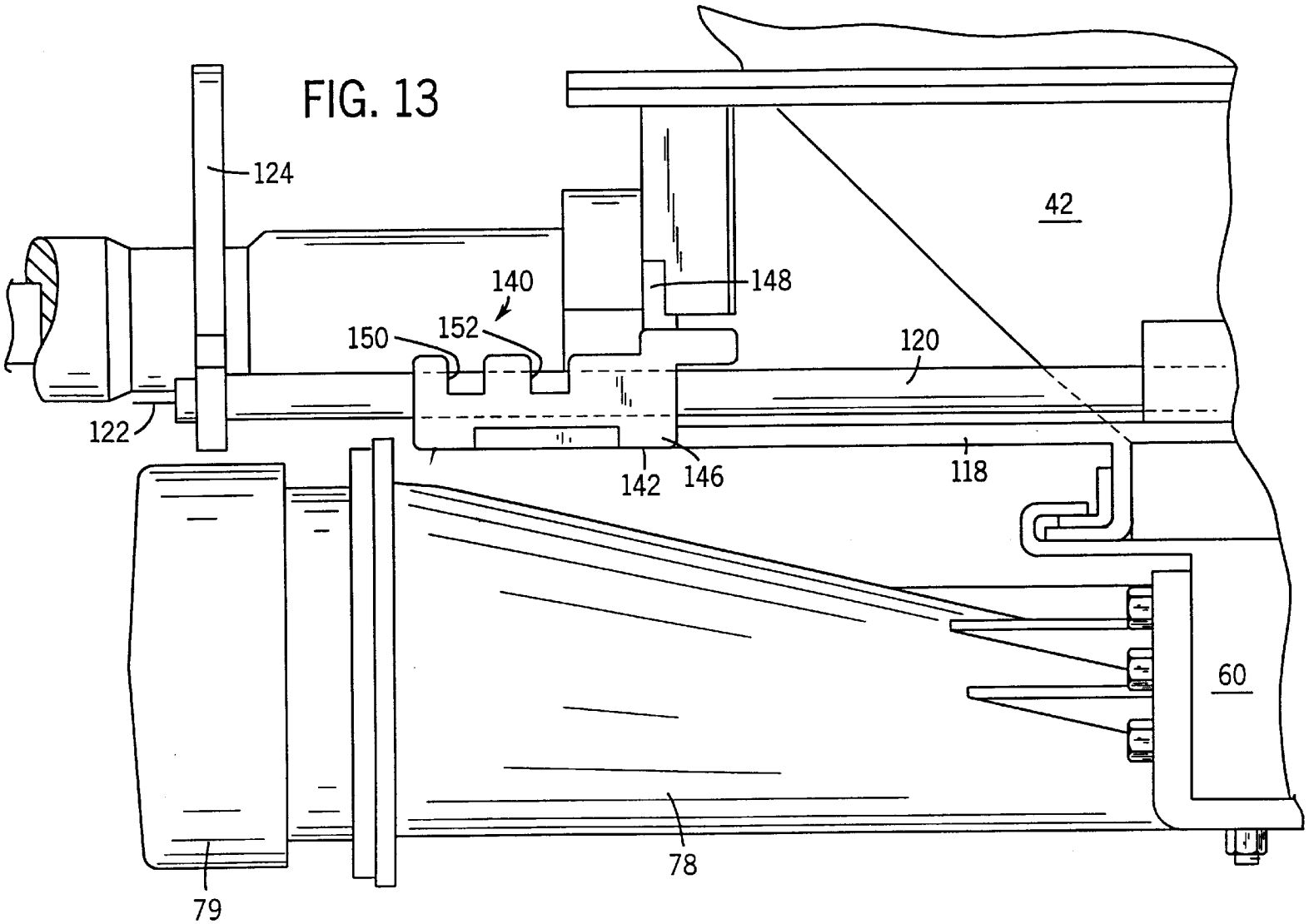
FIG. 13 is an enlarged end view of a fragmentary portion of the apparatus of the drive mechanism illustrated in FIG. 12.

In the illustrated embodiment, the holders 142 and 144 are substantially similar. Accordingly, only holder 142 will be described in detail. As shown in FIGS. 12 and 13, each holder of the detent mechanism 140 includes an upstanding member 146 carried on the base 118 of the apparatus 116 and a detent 148 carried on and movable with the shaft or control rod 120. Member 146 of each holder 140 has two laterally spaced notches or reliefs 150 and 152 formed thereon which are representative of two different conditions or positions of the apparatus 116. In the particular embodiment illustrated, each upstruck member 146 of detent mechanism 140 is configured to limit rotational movement of the respective detent 148 and thereby the control rod 120 about axis 122. Each notch or relief 150, 152 is configured to releasably accommodate a portion of the detent 148 carried in the control rod 120 therewithin. As will, be appreciated by those skilled in the art, the resilient action of the spring 136 urges the detents 148 in a sideways or lateral direction furthermore facilitating operation of the detent mechanism 140 by holding the detent 148 within the selected relief or recess 150, 152 of the detent mechanism 140 and thereby maintaining the actuators 128, 130 of the apparatus 116 in a selected position relative to the frame 32 of the gate assembly 30.

In the illustrated embodiment, the holders 142 and 144 are substantially similar.

Accordingly, only holder 142 will be described in detail. As shown in FIGS. 12 and 13, each holder of the detent mechanism 140 includes an upstanding member 146 carried on the base 118 of the apparatus 116 and a detent 148 carried on and movable with the shaft or control rod 120.

The drive mechanism 88 for the gate assembly 30 is lost motion connected to the door 50 through the apparatus 116. The lost motion connection can take many different forms. Suffice it to say, the lost motion connection allows the operating shaft assembly 90 of gate assembly 30 a predetermined amount or degree of free initial rotation before the door 50 begins to move toward an open position and relative to frame 32.

As shown in FIG. 4, the door 50 is provided with a pair of laterally spaced latches 160 and 162. As will be appreciated from an understanding of the present invention, the number of latches on the door 50 will correspond to the number of actuators provided in combination with the apparatus 116 of drive mechanism 88. As shown, the latches 160, 162 project in a fore-and-aft direction from and beyond a laterally extending edge of the door 50. Since the latches 160, 162 are substantially similar to each other only latch 160 will be described in detail.

As shown in FIGS. 4 and 14, each latch 160, 162 is formed from a rigid material such as steel or the like and has sufficient strength such that when a pulling or pushing force is applied thereto, the latch 160, 162 will be able to withstand such forces applied thereto without any detrimental change to the configuration of the latch 160, 162. Toward the terminal end thereof, each latch 160, 162 is provided with a hook-like configuration 164 defining an actuator engaging surface 166. Each latch 160, 162 is furthermore provided with another actuator engaging surface 168 disposed in spaced fore-and-aft direction and closer to the edge of the door 50 than is surface 166.

When the door 50 is in a closed position relative to the discharge opening 34, and apparatus 116 of drive mechanism 88 is conditioned in a locked condition or position, the actuators 128, 130 of the apparatus 116 are in a position as schematically illustrated in solid lines in FIG. 14. If the operator desires to move the door 50 toward an open position relative to the frame 32 of the gate assembly 30, the operator would initially position the apparatus 116 in a condition to open the door 50.

Conditioning the apparatus 116 to open the door 50 is easily and readily effected by the operator positioning the control rod 120 and, thus, the actuators 128, 130 carried by the control rod 120 in the predetermined path of movement of the door 50. With the present invention, placing the actuators 128, 130 in the path of travel of the door 50 involves positioning the actuators 128, 130 relative to the latches 160, 162 on the door 50. Linear displacement of the control rod 120 to open the door 50 results in the actuators 128, 130 being linearly displaced to the position schematically illustrated in phantom lines in FIG. 14. Once the operator linearly positions the control rod 120 and actuators 128, 130 of the apparatus 116 to open the door 50, the control rod 120 is preferably rotated about axis 122 to a position illustrated in FIG. 11B such that the detent mechanism 140 thereafter releasably holds the apparatus 116 in the position or condition selected by the operator.

Once the apparatus 116 has been conditioned to move the door 50 toward an open position, the operator can thereafter impart rotational movements to the operating shaft assembly 90. Rotational movements imparted to the operating shaft assembly 90 cause linear displacement of the rack and pinion assembly 100. More specifically, rotation of the operating shaft assembly 90 causes the racks 106, 108 to linearly move or slide relative to the frame 32 and relative to door 50. Of course, the direction of linear displacement of the racks 106, 108 is determined by the rotational direction of the operating shaft assembly 90. During initial rotation of the operating shaft assembly 90 in a direction to open the door 50, the racks 106, 108 slidably move in a direction whereby the racks progressively move in a linear fore-and-aft direction away from the end wall 42 of frame 32.

As the racks 106, 108 of the rack and pinion assembly 100 are driven away from the frame 32, the apparatus 116 of the drive mechanism 90 moves conjointly therewith. Accordingly, the control rod 120 and actuators 128, 130 carried thereby move with the apparatus 116 and the racks 106, 108 in response to rotation of the operator shaft assembly 92. Notably, linear movement of the racks 106, 108 of the drive mechanism 88 results in displacement of the actuators 128, 130 from the phantom line position to the dashed line position illustrated in FIG. 14 whereat the actuators 128, 130 are positioned to engage the actuator engaging surface 166 on each latch 160, 162 of the door 50. It is important to note, however, as the actuators 128, 130 move from the phantom line position to the dashed line position in response to initial rotation of the operating shaft assembly 90 no linear movement of the door 50 is effected. No linear movement of the door 50 is effected until the actuators 128, 130 are in engagement with the actuator engaging surface 166 on a latch 160, 162 associated with the door 50. Once the actuators 128, 130 engage the actuator engaging surface 166 on the latch 160, 162 further linear movement of the actuators 128, 130 caused by rotation of the operating shaft assembly 90 will cause linear displacement of the door 50 toward an open position. Thus, the drive mechanism 88 advantageously provides lost motion in connection with rotation of the operating shaft assembly 90 and movement of the door 50 toward an open position.

To move the door 50 toward a closed position, the apparatus 116 is conditioned to position the actuators 128, 130 in the path of travel of the door 50. In the illustrated embodiment, positioning the actuators 128, 130 for engagement with the actuator engaging surface 168 on either latch 160, 162 will suffice for effecting movement of the door 50 toward a closed position. Thereafter, the operating shaft assembly 90 is rotated in a direction opposite from the opening direction. As such, the rotation of the operating shaft assembly 90 will effect linear retraction of the racks 106, 108, thus, causing movement of the apparatus 116 toward the end wall 42 of the frame 32 of gate assembly 30. Movement of the apparatus 116 toward the end wall 42 of the frame 32 of gate assembly will cause the actuators 128, 130 of apparatus 116 to abut and engage the actuator engaging surface 168 defined by each latch 160, 162. As will be appreciated, further rotation of the operating shaft assembly 90 will cause further displacement of apparatus 116 and the actuators 128, 130 toward the end wall 42 of the frame 32 of gate assembly 30, thus, ultimately closing the door 50 relative to the discharge opening 34 and the frame 32 of the gate assembly 30.

Alternatively, the apparatus 116 of the drive mechanism 88 can be selectively conditioned to operably engage and position only the open top pan assembly or second modular element 60 relative to the frame 32 of the gate assembly 30. Movement of only the top pan assembly or second modular element 60 toward an open position is likewise effected by positioning the actuators 128, 130 of the apparatus 116 into the path of travel of the top pan assembly 60 and thereafter rotating the operating shaft assembly 90 to enable the apparatus 116 and, thus, move the pan assembly 60.

Returning to FIGS. 3 and 5, in the illustrated form of the invention, the open top pan assembly or modular element 60, is provided with a pair of laterally spaced fore-and-aft extending arms 170, 172 projecting from that end of the pan assembly 60 adjacent the end wall 42 of frame 32 when the pan assembly 60 is in a closed position relative to the discharge opening 34. The arms 170, 172 extending from the pan assembly 60 are substantially identical and, therefore, only arm 170 will be described in detail.

Figure 16:
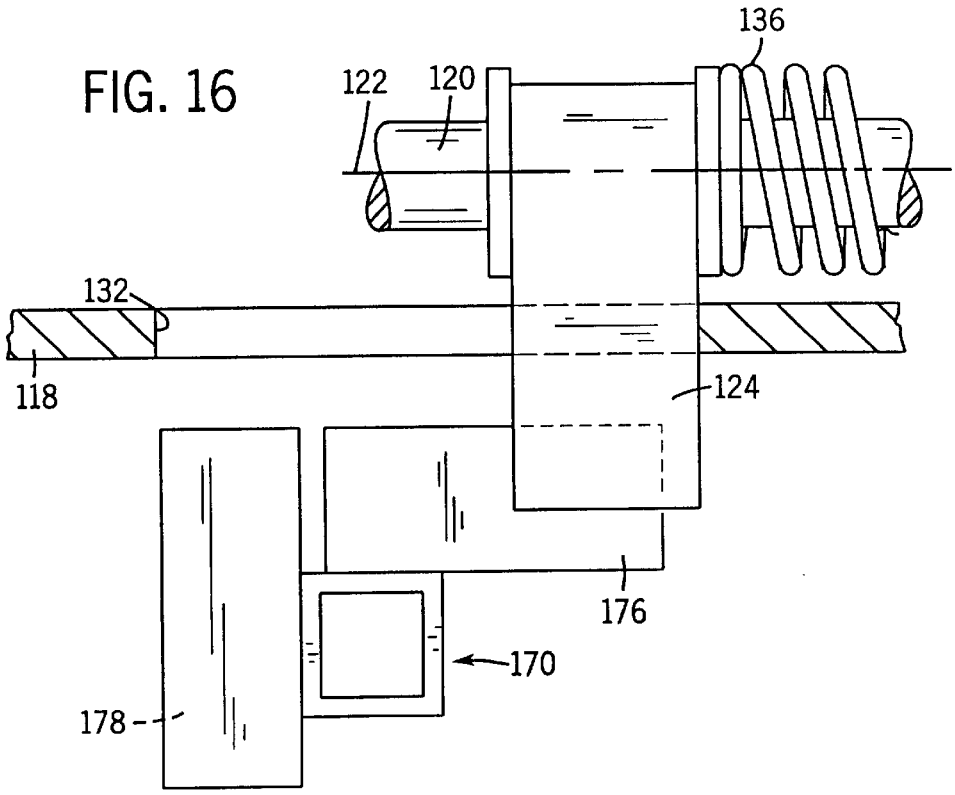
FIG. 16 is a schematic end elevational view of the various components illustrated in FIG. 15.
Figure 15:
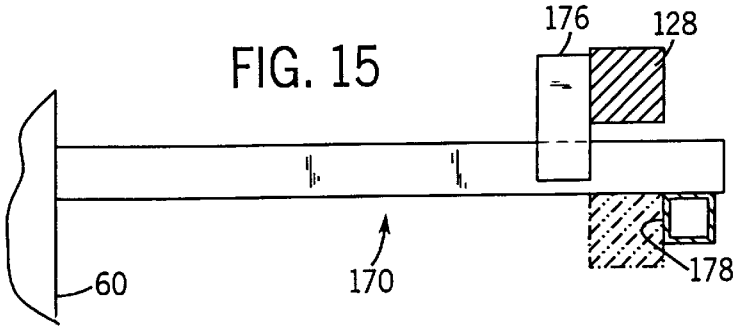
FIG. 15 is a schematic representation of the relative position of various components of the apparatus of the drive mechanism and pan element when the apparatus is arranged in different conditions.

As schematically represented in FIGS. 15 and 16, each arm 170, 172 of pan assembly 60 is preferably formed as a rigid material tube having sufficient strength such that when a pulling or pushing force is applied thereto the tube 170, 172 will withstand such forces applied thereto without any detrimental change to the configuration of the tube. Preferably, the tubes have hollow cross-sectional configurations to reduce the overall weight of the gate assembly 30. Toward a free end thereof, each arm 170, 172 is provided with laterally spaced actuator engaging surfaces 176 and 178 preferably disposed to opposite sides of the longitudinal axis of each arm 170, 172. Moreover, and as illustrated in FIG. 15, the actuator engaging surfaces 176, 178 on each arm 170, 172 are also spaced apart in a fore-and-aft direction by a distance generally equal to or slightly greater than the thickness of the actuators 128, 130 of apparatus 116.

Notably, the actuator engaging surfaces 176, 178 on the arms 170, 172 of pan assembly 60 are laterally spaced from the actuator engaging surfaces 166, 168 on the latches 160, 162 of door 50. Accordingly, linear positioning of the control rod 120 of apparatus 116 will effect opening movement of only the door 50 or the pan assembly 60 but not both depending on the disposition or conditioning of the apparatus 116.

When the pan assembly 60 is in a closed position relative to the discharge opening 34 on the frame 32 of the gate assembly 30, and apparatus 116 of drive mechanism 90 is conditioned in a locked condition or position, the actuators 128, 130 of apparatus 116 are in a position as schematically represented in solid lines in FIGS. 15 and 16. If the operator desires to move the pan assembly 60 toward an open position relative to the frame 32 of the gate assembly 30, the operator would position the apparatus 116 in a condition (FIG. 11A) to open the pan assembly 60.

With the present invention, conditioning the apparatus 116 to open the pan assembly 60 is easily and readily effected by the operator positioning the control rod 120 and, thus, the actuators 128, 130 carried by the control rod 120 in the predetermined path of travel of the pan assembly 60. Placing the actuators 128, 130 of the apparatus 116 in the path of travel of the pan assembly 60 involves positioning the actuators 128, 130 relative to the actuator engaging surface 178 of each arm 170, 172 on the pan assembly 60. As will be appreciated from an understanding of the present invention, linear displacement of the control rod 120 of apparatus 116 to the position illustrated in FIG. 11A results in the actuators 128, 130 of apparatus 116 being linearly displaced to the position schematically represented in phantom lines in FIG. 15. Once the operator positions the control rod 120 and actuators 128, 130 of the apparatus 116 to open the pan assembly 60, the control rod 120 is preferably rotated about the axis 122 of rod 120 such that the detent mechanism 140 thereafter releasably holds the apparatus 116 in the position or condition selected by the operator.

Once the apparatus 116 has been conditioned to move the pan assembly 60 toward an open position and relative to the frame 32 of the gate assembly 30, the operator can thereafter impart rotational movement to the operating shaft assembly 90 in a direction to open the pan assembly 60. Rotational movements imparted to the operating shaft assembly 90 cause fore-and-aft linear displacement of the racks 106, 108 of the rack and pinion assembly 100. More specifically, rotation of the operating shaft assembly 90 causes the racks 106, 108 to linearly move or slide relative to the frame 32. Of course, the direction of linear movement of the racks 106, 108 is determined by the rotational direction of the operating shaft assembly 90. During initial rotation of the operating shaft assembly 90 in a direction to open the pan assembly, the racks 106, 108 slidably move in a direction whereby the racks 106, 108 progressively move in a linear fore-and-aft direction away from the end wall 42 of frame 32.

As the racks 106, 108 of the rack and pinion assembly 100 are driven away from the frame 32, the apparatus 116 of the drive mechanism 88 moves conjointly therewith. Accordingly, the control rod 120 and the actuators 128, 130 carried thereby move with the apparatus 116 and the racks 106, 108 in response to rotation of the operating shaft assembly 90. Notably, linear movement of the racks 106, 108 of the drive mechanism 88 results in displacement of the actuators 128, 130 away from the end wall 42 of the frame 32 of gate assembly 30 and into engagement with the actuator engaging surface 178 of each arm 170, 172. Once the actuators 128, 130 are engaged with the surface 178 on the arms 170, 172 further linear movement of the actuators 128, 130 away from the end wall 42 of the gate assembly 30 caused by rotation of the operator shaft assembly 90 will cause linear movement of the pan assembly 60 toward an open position relative to the frame 32 of the gate assembly 30.

With this form of the invention, and as mentioned above., the fore-and-aft spacing between actuator engaging surfaces 176, 178 on the arms 170, 172 of the pan assembly 60 is equal to the width of the actuators 128, 130 of the apparatus 116 of drive mechanism 88. Accordingly, the actuators 128, 130 are free to pass between the actuator engaging surfaces 176, 178 without requiring or effecting linear displacement of the pan assembly 60. Because the distance between the actuator engaging surfaces 176, 178 of each arm 170, 172 is generally equal to or slightly greater than the width of each actuator 128, 130 of apparatus 116, movement of the pan assembly 60 will be effected upon initial rotation of the operating shaft assembly 90. As such, the pan assembly 60 will travel a greater linear distance between open and closed positions than does the door 50 between open and closed positions.

To move the pan assembly 60 toward a closed position, the apparatus 116 is conditioned to position the actuators 128, 130 in the path of travel of the pan assembly 60. In the illustrated embodiment, positioning the actuators 128, 130 for engagement with the actuator engaging surface 176 on the arms 170, 172 of the pan assembly 60 requires release of the apparatus 116 from its engagement with the holder 140 thereby allowing the spring 136 to return the actuators 128, 130 to the solid line position illustrated in FIGS. 15 and 16. Thereafter, the operating shaft assembly 90 is rotated in a direction opposite from the opening direction. As such, the rotation of the operating shaft assembly 90 will effect linear retraction of the racks 106, 108 and, thus, causing movement of the apparatus 116 toward the end wall 42 of the frame 32 of gate assembly 30. The movement of the apparatus 116 toward the end wall 42 of the frame 32 of gate assembly will cause the actuators 128, 130 of apparatus 116 to abut and engage the actuator engaging surface 176 defined on each arm 170, 172. As will be appreciated, further rotation of the operating shaft assembly 92 will cause further displacement of apparatus 116 and the actuators 128, 130 toward the end wall 42 of the frame 32 of gate assembly 30, thus, ultimately closing the pan assembly 60 relative to the discharge opening 34 and the frame 32 of the gate assembly 30.

Special concerns are presented when the gate assembly 30 is conditioned for use with the other modular element or flat plate 80. As will be appreciated by those skilled in the art, the flat sanitary plate 80 is specifically designed to inhibit debris from contaminating the underside 56 of the door 50 and the plenum chamber 57. The sanitary plate 80, however, is neither configured nor designed to withstand the full weight of the commodity within the enclosure 12 thereon. Accordingly, an important design concern involves movement of the sanitary plate 80 in timed relation relative to movement of the door 50 relative to the frame 32 of the gate assembly 30. Movement of the sanitary plate 80 in timed relation relative to movement of the door 50 toward an open position is again effected by conditioning the apparatus 116 of the drive mechanism 90 to accomplish the desired result.

Returning to FIG. 6, the modular element or sanitary plate 80 is preferably provided with a pair of laterally spaced fore-and-aft extending arms 180, 182 projecting away from that end of plate 80 adjacent the end wall 42 of frame 32 when the second modular element 80 is in a closed position relative to the discharge opening 34. The arms 180, 182 extending from the plate 80 are substantially identical relative to each other and, therefore, only arm 180 will be described in detail.

Figure 17:
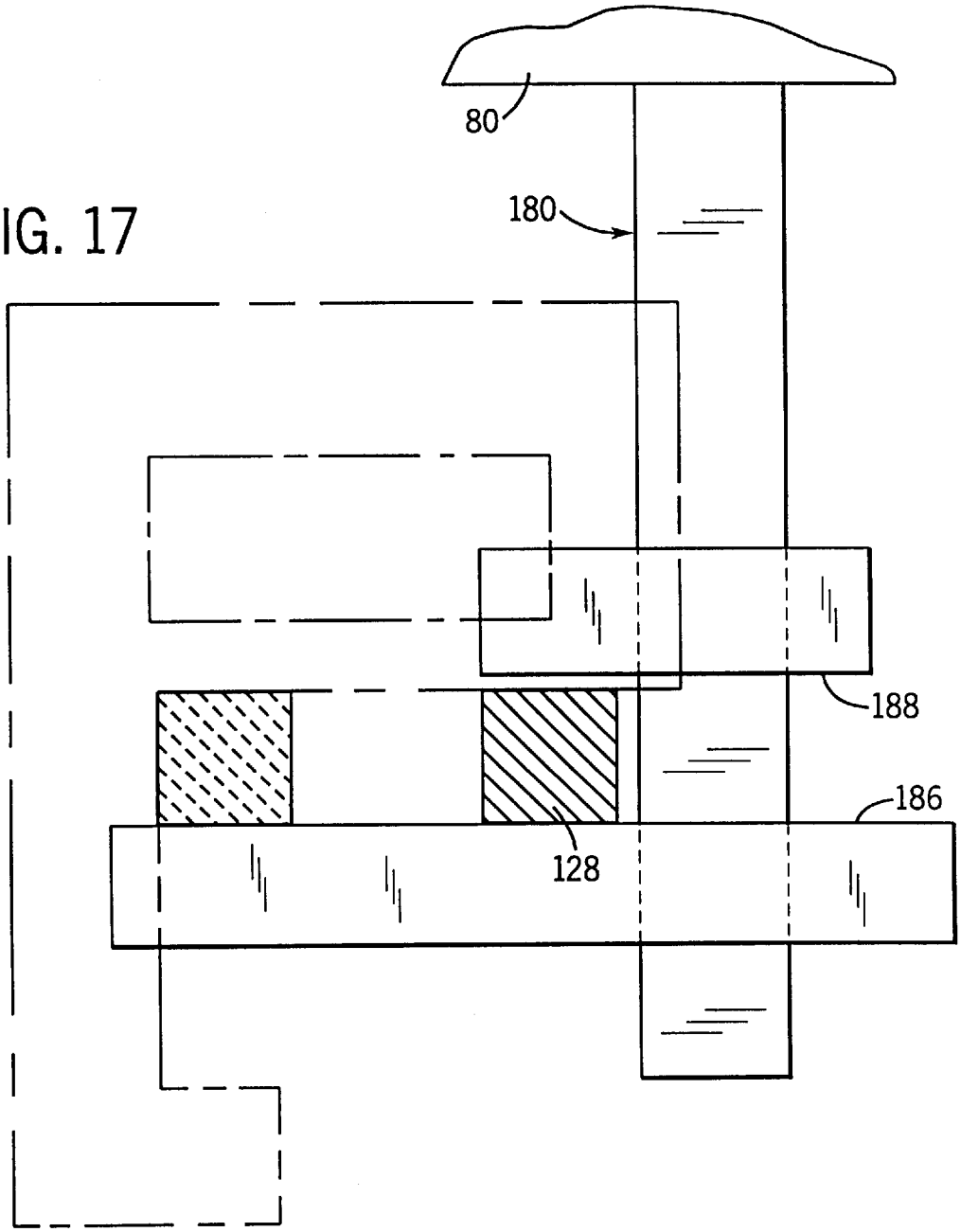
FIG. 17 is a schematic representation of the relative position of various components of the apparatus of the drive mechanism, door and sanitary plate when the apparatus is arranged in different conditions, with the door being schematically illustrated in phantom lines.

As schematically represented in FIG. 17, each arm 180, 182 is preferably formed as a rigid material tube having sufficient strength such that when a pulling or pushing force is applied thereto the tube 180, 182 will withstand such forces applied thereto without any detrimental change to the configuration of the tube. Preferably, the tubes 180, 182 each have hollow cross-sectional configurations to reduce the overall weight of the gate assembly 30. Toward a free end thereof, each arm 180, 182 is provided with a laterally elongated actuator engaging surface 186. Moreover, and as illustrated in FIG. 17, each arm 180, 182 of the second modular element 60 includes an actuator engaging surface 188 spaced apart in a fore-and-aft direction from actuator engaging surface 186.

The fore-and-aft spacing between the actuator engaging surfaces 186, 188 on each arm 180, 182 of the plate or second modular element 60 is equal to the width of the actuators 128, 130 of the apparatus 116 of drive mechanism 88. Accordingly, the actuators 128, 130 of apparatus 116 are free to pass between the actuator engaging surfaces 186, 188 without requiring or effecting linear displacement of the plate 80. Because the distance between the actuator engaging surfaces 186, 188 on each arm 180, 182 is generally equal to or slightly greater than the width of each actuator 128, 130 of apparatus 116, movement of the plate 80 will be effected upon initial rotation of the operating shaft assembly 90. As such, the plate or second modular element 80 will travel a greater linear distance between open and closed positions than does the door 50 between open and closed positions upon actuation of the operating shaft assembly 90. Moreover, this design permits substantially immediate movements of the lower element 60, 80 to overcome the associated static friction forces applied thereto.

When the plate or second modular element 80 is in a closed position relative to the discharge opening 34 on the frame 32 of the gate assembly 30, and apparatus 116 of drive mechanism 88 is conditioned in a locked condition or position, the actuators 128, 130 of apparatus 116 are in a position as schematically represented in solid lines in FIG. 17. The vertical elongation of the actuator engaging surface 178 assures the sanitary plate or second modular element 80 will conjointly open along with and in advance of opening of the door 50. As such, concerns about the commodity in the enclosure 12 of the hopper car 10 placing a substantial load on the sanitary plate 80 are eliminated.

With the present invention, conditioning the apparatus 116 to open the plate 80 is easily and readily effected by the operator positioning the control rod 120 and, thus, the actuators 128, 130 carried by the control rod 120 in the predetermined path of travel of the plate 80. Placing the actuators 128, 130 of the apparatus 116 in the path of travel of the plate 80 involves positioning the actuators 128, 130 relative to the actuator engaging surfaces 186, 188 on the pan assembly 60. Linear displacement of the control rod 120 of apparatus results in the actuators 128, 130 being linearly displaced to the position schematically represented in phantom lines in FIG. 17. Once the operator positions the control rod 120 and actuators 128, 130 of the apparatus 116 to open the plate 80, the control rod 120 is preferably rotated about the axis 122 of rod 120 such that the detent mechanism 140 thereafter releasably holds the apparatus 116 in the position or condition selected by the operator.

Once the apparatus 116 has been conditioned to move the plate 80 toward an open position and relative to the frame 32 of the gate assembly 30, the operator can thereafter impart rotational movement to the operating shaft assembly 90 in a direction to open the plate 80. As will be appreciated from an understanding of the present invention, rotational movements imparted to the operating shaft assembly 90 cause linear displacement of the rack and pinion assembly 100. More specifically, rotation of the operating shaft assembly 90 causes the racks 106, 108 to linearly move or slide relative to the frame 32. Of course, the direction of linear movement of the racks 106, 108 is determined by the rotational direction of the operating shaft assembly 90. During initial rotation of the operating shaft assembly 90 in a direction to open the plate 80, the racks 106, 108 of rack and pinion assembly 100 are slidably displaced relative to the door 50 and the frame 32 of the gate assembly 30.

As the racks 106, 108 of the rack and pinion assembly 100 are driven away from the frame 32, the apparatus 116 of the drive mechanism 88 moves conjointly therewith. Accordingly, the control rod 120 and the actuators 128, 130 carried thereby move with the apparatus 116 and the racks 106, 108 in response to rotation of the operating shaft assembly 90. Notably, linear movement of the racks 106, 108 of the drive mechanism 88 results in displacement of the actuators 128, 130 away from the end wall 42 of the frame 32 of gate assembly 30 and into pressing or intimate engagement with the actuator engaging surface 186 associated with the plate 80. Once the actuators 128, 130 are engaged with the surface 186 on the arms 180, 182 further movement of the actuators 128, 130 away from the end wall 42 of the gate assembly 30 caused by rotation of the operator shaft assembly 90 will cause linear movement of the plate 80 toward an open position relative to the frame 32 of the gate assembly 30.

To move the plate 80 toward a closed position, the apparatus 116 is conditioned to position the actuators 128, 130 in the path of travel of the plate 80. In the illustrated embodiment, positioning the actuators 128, 130 of the apparatus 116 for engagement with the actuator engaging surface 188 on the arms 180, 182 of the plate 80 will suffice for effecting movement of the plate 80 toward a closed position. Thereafter, the operating shaft assembly 90 is rotated in a direction opposite from the opening, direction. As such, the rotation of the operating shaft assembly 90 will effect linear retraction of the racks 106, 108 and, thus, causing movement of the apparatus 116 toward the end wall 42 of the frame 32 of gate assembly 30. The movement of the apparatus 116 toward the end wall 42 of the frame 32 of gate assembly 30 will cause the actuators 128, 130 of apparatus 116 to abut and engage the actuator engaging surface 188 defined on each arm 180, 182. As will be appreciated, further rotation of the operating shaft assembly 90 will cause further displacement of apparatus 116 and the actuators 128, 130 toward the end wall 42 of the frame 32 of gate assembly 30, thus, ultimately closing the plate 80 relative to the discharge opening 34 and the frame 32 of the gate assembly 30.

Figure 18:
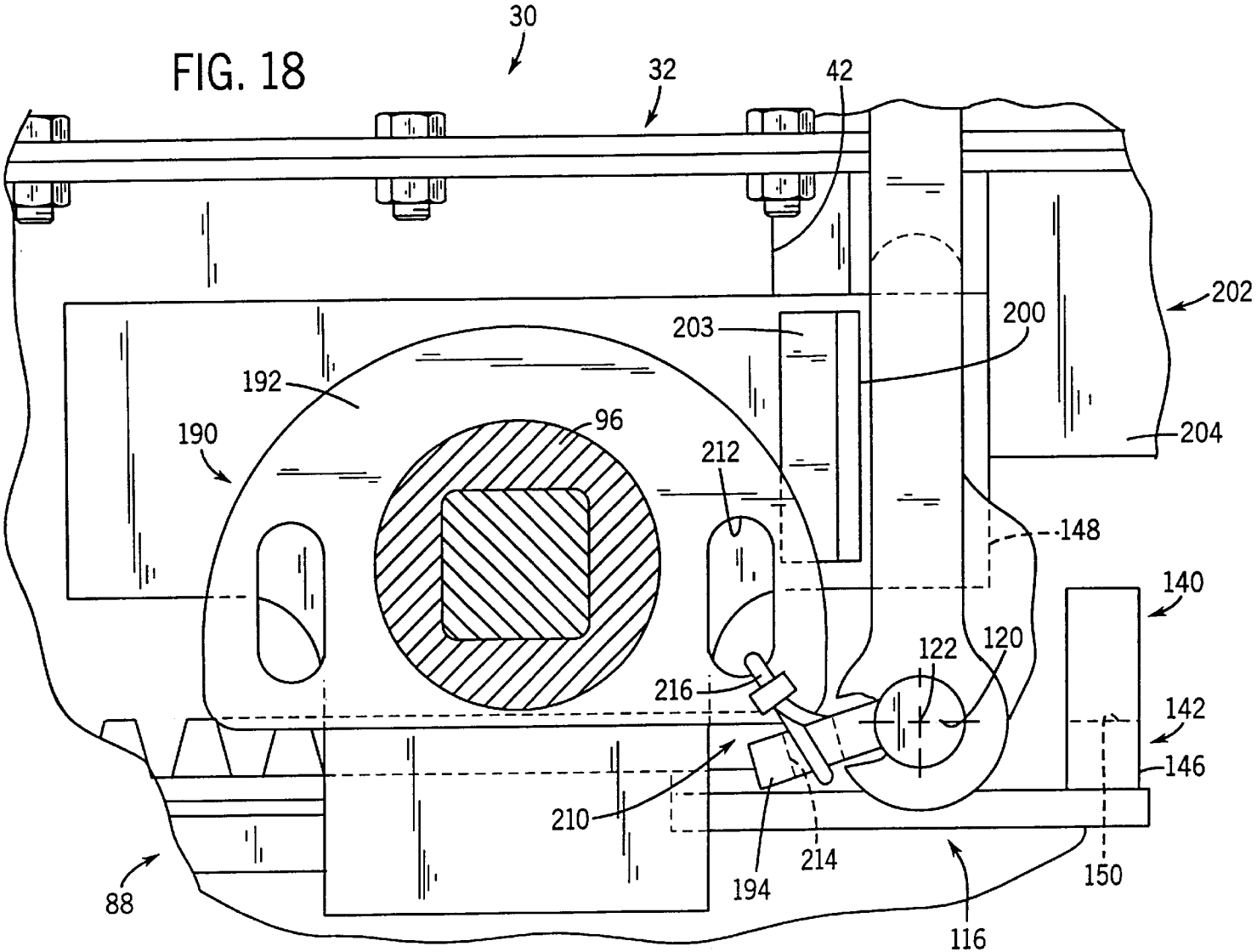
FIG. 18 is an enlarged side elevational view of a tamper seal arranged in operative combination with a portion of the drive mechanism.

Turning to FIG. 18, when the apparatus 116 is returned to a position adjacent the end wall 42 of the gate assembly 30, the apparatus 116 is automatically returned to a locked condition. In the illustrated form, cam structure 190 is provided for positively locking the apparatus 116 relative to the frame 32 of the gate assembly 30 when the apparatus 116 is returned to a position adjacent the end wall 42 of the frame 32. In the illustrated form, the cam structure 190 includes an actuating member or cam 192 arranged on each capstan 96 of the operating shaft assembly 90 and a cam follower 194 radially projecting outwardly from control rod 120 and into the path of movement of a respective cam 192 when the apparatus 116 is returned to a position adjacent the end wall 42 of the frame 32. When the operating shaft assembly 90 is rotated to return the apparatus 116 adjacent the end wall of the frame 32, the rotating cam 192 positively engages the cam follower 194 thereby displacing the members 148 of the detent mechanism 140 and, thus, rotating the control rod 120 about axis 122 so as to permit the spring 136 (FIG. 11) to resiliently bias the detents 148 into a locked position relative to the frame 32 of the gate assembly 30.

The apparatus 116 furthermore serves to inhibit inadvertent displacement of the door 50 or the modular element 60, 80. As illustrated in FIG. 12, when the apparatus 116 is in locked condition, each detent 148 of the detent mechanism 140 is removably constrained within an upstruck channel 200 provided on the frame 32 of the gate assembly 30. Accordingly, if rotational movement is imparted to the operating shaft assembly 90, the inability of the detents 148 of apparatus 116 to be removed from the channel 200 inhibits linear displacement of the racks 106, 108 of the rack and pinion assembly 100 thus locking the door 50 and the second modular element 60, 80 arranged on the gate assembly 30 against linear displacement relative to the frame 32 of the gate assembly 30. Other alternative locking arrangements for inhibiting linear displacement of the door 50, element 60, 80, and apparatus 116 would equally suffice without detracting or departing from the spirit and cope of the present invention.

In a preferred form, a front end portion or side of the upstruck channel 200 is defined by cam structure 202 preferably projecting away from and angularly disposed relative to the end wall 42 of the frame 32. An opposite end portion or side of the upstruck channel 200 is defined by bracket structure 203 provided on the frame 32 of the gate assembly 10. The cam structure 202 preferably comprises a pair of preferably identical laterally spaced cams 204 and 206 (FIG. 2) disposed for engagement by the free ends of the detents 148 of the detent mechanism 140 when the apparatus 116 is returned to a position adjacent the end wall 42 of the frame 32.

To return the door 50 and element 60, 80 to a closed position relative to the discharge opening 34 of the frame 32, the apparatus 116 is conditioned to the position illustrated in FIG. 11. In this position, the detents 148 of the detent mechanism 140 are disengaged from their respective holders 146 and spring 136 urges the detents 148 to the position illustrated in FIG. 11. As the apparatus 116 is returned to a closed or locked condition, the purpose of the cams 204, 206 is to engage the free ends of the detents 148 of the detent mechanism 140 and thereby urge the control rod 120 in a linear direction against the action of spring 136. Notably, each cam 204, 206 terminates at and opens to the upright channel 200. As such, and after the detents 148 of the detent mechanism 140 pass over the cams 204, 206 they are automatically urged into a locked condition relative to the frame 32 by the spring 136, thus, placing the apparatus 116 in a locked condition.

As shown in FIG. 18, a railcar seal 210 can be arranged in combination with the apparatus 116 for visually indicating whether the drive mechanism 88 has been operated to move either the door 50 or the modular element 60, 80 arranged on the gate assembly 30 toward an open position. As illustrated in FIG. 18, each cam 192 of can structure 190 is provided with a through slot or opening 212 having a closed margin. Moreover, each cam follower 194 on the cam structure 190 defines an aperture or opening 214 having a closed margin. The railcar seal 210 preferably comprises a ribbon-like band 216 which passes through the opening 212 on the cam 192 and the aperture or opening 214 on the cam follower 194, with opposite ends of the band 216 being secured to each other to provide a visual indication of railcar tampering. As will be appreciated by those skilled in the art, the band 216 is fabricated from a material which can withstand normal forces applied thereto but which will fail when a rotational force is imparted to the drive mechanism 88 to open door 50 or the modular element 60, 80 mounted on the gate assembly 30.

Another salient feature or aspect of the present invention relates to seal structure 220 for inhibiting debris and insect infiltration between the frame 32, door 50 and the second modular element 60, 80 arranged on the gate assembly 30 of the present invention. As shown in FIG. 19, a portion of the seal structure 220 involves providing a seal 222 transversely across a lateral edge or portion of the second modular component 60, 80 between the tracks 106, 108 of the rack and pinion assembly 100 (FIG. 2) in sealing engagement with the flange-like configuration 58 at the lower end of the end wall 40 of frame 32 of gate assembly 30 thereby sealing the gate assembly 30 across that end thereof. In the illustrated form of the invention, seal 222 is supported by a depending flange 223 provided on the second modular element 60, 80. A suitable fastener 225, such as a threaded bolt and nut, can be used to releasably fasten the seal 222 to the flange 223.

Seal 222 is preferably formed as an elongated and hollow elastomeric member 224 configured for energization regardless of the direction of movement of the gate assembly component with which the seal 222 is arranged in operable combination. Moreover, seal 22 allows horizontal discontinuities of either the door 50 or the modular element 60, 80 such that the seal 22 will automatically re-energize through either open or close direction manipulation of the components horizontal discontinuity removal. As illustrated in FIG. 20, seal 222 includes an elongated and preferably extruded member 224 preferably including a mounting portion 226 defining an axis 228 extending generally parallel to the predetermined path of travel of the door 50. Because the commodity transported and held within the enclosure 12 of hopper car 10 can constitute food grade material, member 224 used to fabricate the seal 222 is of the type approved by the FDA and conforms to the FDA Food Contact Requirements. In a most preferred form, member 224 is formed from a clean grade santoprene of proper hardness. Preferably, member 224 has a hardness ranging between about 70 and about 76 Shore A hardness.

In the illustrated embodiment, a first radial surface 230 is disposed to one side of the mounting portion 226 of member 224 for allowing relative movement of the surface arranged in sealing relationship therewith in either linear direction relative thereto. As shown, the first radial surface 230 of seal 222 is preferably arranged in tangential engaging relation relative to the flat surface or flange-like configuration 58 on the frame 32 of the gate assembly 30. The first radial surface 230 of member 224 is preferably provided with at least one elongated rib 232 projecting away from the radial surface 230 for enhancing the sealing ability of the sealing surface 230. In a most preferred form, the first radial surface 230 of member 224 defines a second elongated rib 234 extending generally parallel to the first rib 232 and projecting away from the radial surface 230 to complement and further enhance the sealing ability of the radial surface 230.

In the illustrated embodiment, a second radial surface 240 is disposed to an opposite side of the mounting portion 226 of member 224 in diametrically opposed relation to the first radial surface 230. In this illustrated embodiment of member 224, the mounting portion 226 is centrally disposed between the first and second radial surfaces 230 and 240, respectively. As such, member 224 is reversible about the axis 226 thereby prolonging the useful life of the seal 222. The second radial surface 240 of member 224 is preferably provided with at least one elongated rib 242 projecting away from the radial surface 240 for enhancing the sealing ability of the sealing surface 240. The second radial surface 240 of member 224 defines a second elongated rib 244 extending generally parallel to the first rib 242 and projecting away from the radial surface 240 to complement and further enhance the sealing ability of the radial surface 240.

As illustrated in FIG. 21, another portion of seal structure 220 involves providing a seal 252 transversely across the upper surface 55 of and toward an end of the door opposite from seal portion 222. Suffice it to say, seal 252 is substantially identical to seal 222 discussed above. The seal 252 is preferably mounted to an exterior of and extends generally parallel to end wall 42 of frame 32. Moreover, seal 252 extends across the upper surface 55 of door 50 and between the tracks 106, 108 of the rack and pinion assembly 100. The primary purpose of seal 252 is to inhibit contamination and insect infiltration between frame 32 of gate assembly 30 and the upper surface 55 of or 50 during transport and storage of the hopper car 10.

As will be appreciated by those skilled in the art, and as illustrated in FIG. 21, the end wall 42 of frame 32 is required to have an opening or elongated slot 260 allowing for horizontal movement of the door 50 and the second modular element 60, 80 arranged in association with the door 50 on the gate assembly 30 between open and closed positions. Of course, such an opening 260 likewise provides a conduit or passage extending across the entire bottom or lower surface 56 of door 50. Opening 260 would normally permit dirt, dust, smoke, water and related debris to enter and, thus, contaminate the discharge plenum 57 and the lower surface 56 of the door 50. Still another aspect of the present invention relates to providing a portion of seal structure 220 such as seal 262 transversely across the opening 260 between the lower surface 56 of the door 50 and the second modular element 60, 80 arranged in association with the door 50 in a manner sealing the opening 260 to prevent contamination of the lower surface 56 of the door 50 and the discharge plenum 57.

Suffice it to say, seal 262 is substantially identical to seal 222 discussed above. The seal 262 is preferably mounted to an exterior of and extends generally parallel to end wall 42 of frame 32. Moreover, seal 262 extends across the lower surface 56 of door 50 and between the tracks 106, 108 of the rack and pinion assembly 100. Furthermore, the seal 262 extends across the second modular element 60, 80 arranged in operable association with the door 50 on the gate assembly 30. As such, the seal 262 functions as a compression/wiper seal. Notably, the dual radial surfaces on seal 262 advantageously extend in tangential relationship with the door 50 and the second modular element 60, 80 arranged in association with the door 50 such that the single seal 262 serves a dual purpose while permitting horizontal movement of the elements 50, and 60, 80 in either linear direction without detracting or departing from its effectiveness as a seal. Furthermore, and as will be appreciated by those skilled in the art, seal 262 is configured to permit its energization in either linear direction of movement or travel of the elements 50, 60, 80 with which it is in sealing contact.

In the event it is desired to discharge commodity from the enclosure 12 of the hopper car 10 by means of pneumatics, the gate assembly 30 of the present invention is configured or conditioned with the door 50 and the open top pan assembly 60 as the modular element arranged in combination with the door 50. Advantageously, the drive mechanism 88 of the gate assembly 30 allows for a predetermined range of free rotation of the operating shaft assembly 90 before the lost motion connection between the drive mechanism 88 and the door 50 collapses. The range of free rotation operating shaft assembly 90 ranges between about 90° and about 360°. In a most preferred form, the range of free rotation of the operating shaft assembly 90 is about 125°.

As will be appreciated, after the lost motion connection between the drive mechanism 88 and the door 50 collapses, the operating shaft assembly 90 will have had a range of free rotation thus allowing a relatively high impactual force or load to be imparted to the door 50. The relatively high impactual force on the door 50 assists in moving the door 50 toward an open position. Once the door 50 is moved to an open position, the commodity in the enclosure 12 of car 10 freely passes into the open top pan assembly 60 for subsequent pneumatic discharge.

In the event that it is desired to discharge the commodity from the enclosure 12 of the car 10 by means of gravity only, the gate assembly 30 of the present invention would be conditioned such that door 50 is mounted on the frame 32 in combination with the sanitary plate 80 as the modular element. Advantageously, pan assembly 60 is secured to the frame 32 in the same manner to allow for its linear movement relative to the frame 32 thus yielding a unique modular design which readily lends itself to use of either component or element 60, 80 in combination with the gate assembly 30. Notably, both modular elements 60, 80 act as a sanitary shield for the customer attachment flange 58, the plenum chamber 57, as well as the underside 56 of the door 50.

When the sanitary plate 80 is arranged in combination with the gate assembly 30 as the other modular element, the drive mechanism 88 assures the plate 80 is removed from the beneath the door 50 before the door 50 is moved to an open position thereby eliminating the risk of placing substantial weight on a modular component not designed to support such weight. Additionally, moving the lower modular element 60, 80 facilitates attachment of the customer unloading apparatus to the gate assembly 30. That is, regardless of the setting or conditioning of the apparatus 116, the sanitary plate 80 will be moved in timed relation relative to the door 50 and in such a manner thereby avoiding weighty placement of any commodity thereon. Alternatively, the sanitary plate 80 is configured to inhibit debris such as dirt, water, smoke and related matter from contaminating the discharge plenum 57 or the underside 56 of the door 50.

The seal structure 220 of the present invention furthermore facilitates sealing of the frame 32, door 50, and the modular element 60, 80.arranged on the frame 32 relative to each other thereby inhibiting contaminants from moving therepast. The radial surfaces 230, 240 on the seal structure 220 are preferably arranged in tangential relationship relative to the surfaces they are to seal thereby promoting linear movement of the elements 50, 60, 80 in either direction without detracting or departing from the ability of the seal structure 220 to maintain a sealing relationship therewith. The dual radial surface design furthermore promotes reversal of the seal structure 220 or use of the seal as a compression/wiper seal having energization abilities in either linear direction of movement of the elements with which it maintains a sealing relationship. Moreover, the seal structure 220 yields a continuous sealing function regardless of the linear position of the doorm50 thus promoting the ability to throttle the flow rate of the commodity through the gate assembly.

From the foregoing, it will be observed that numerous modifications and variations can be effected without departing from the true spirit and novel scope of the present invention. Moreover, it will be appreciated that the present disclosure is intended as an exemplification of the invention, and is not intended to limit the invention to the specific embodiments illustrated. Rather, the disclosure is intended to cover by the appended claims all such modifications and variations as fall within the scope of the claims.

What is claimed is:

1. A railroad hopper car having an enclosure for holding and transporting materials and a discharge opening through which the material in said enclosure is discharged from said hopper car, and a gate assembly for controlling the discharge of material from said hopper car, said gate assembly comprising:

a rigid frame disposed about said discharge opening;

an open top pan assembly having a pneumatic outlet port, said pan assembly being slidably mounted on said frame for movement between a first discharge position beneath said discharge opening and a second position removed from said discharge opening;

a door operably mounted on said frame between said discharge opening and said pan assembly for sliding movement between a closed position beneath said discharge opening and an open position away from said discharge opening;

an apparatus for moving either said pan assembly from said first discharge position to said second position or said door from said closed position to said open position such that said gate assembly can be selectively conditioned for either gravitational or pneumatic discharge of materials, and wherein said apparatus is lost motion connected to said door thereby allowing a predetermined range of free rotation of said operating shaft prior to said door being moved toward an open position, and with said lost motion connection allowing said pan assembly to move a greater distance between open and closed positions than does said door when said door moves between open and closed positions; and a single operating shaft carried on said frame for rotation about a fixed axis and arranged in operable combination with said apparatus for imparting independent sliding movements in opposed directions to said pan assembly and said door.

2. The railroad hopper car according to claim 1 wherein said frame has a generally rectangular configuration including a pair of generally parallel laterally spaced side walls rigidly joined to a pair of generally parallel end walls, said frame further defining a plenum chamber arranged in depending and surrounding relation relative to said discharge opening.

3. The hopper car according to claim 1 further including a rack and pinion assembly arranged in operative combination with said operating shaft for moving said pan assembly or said door relative to said frame.

4. The hopper car according to claim 3 wherein said rack and pinion assembly comprises a pair of laterally spaced pinions arranged on said operating shaft and in intermeshing relation relative to a pair of laterally spaced racks, said racks being mounted on said frame in generally parallel relation relative to said side walls.

5. The hopper car according to claim 3 wherein said racks are slidably mounted on said frame in linearly movable relation relative to said pan assembly and said door.

6. The hopper car according to claim 5 wherein said racks are spaced from said frame to lower the coefficient of friction established therebetween when said racks are slidably moved relative to said frame.

7. The hopper car according to claim 3 wherein said apparatus is arranged in operative combination with said rack and pinion assembly such that when said apparatus is in a first condition and said racks are slidably moved said apparatus moves therewith toward and away from an end wall of said frame depending upon the direction of rotation of said operating shaft.

8. The hopper car according to claim 7 wherein said apparatus includes a manually movable rod mounted for generally linear movement along a path extending generally parallel with an end wall of said frame, said rod having mounted thereon an actuator extending into the predetermined path of travel and capable of engaging either said pan assembly or said door as a function of the linear disposition of said rod.

9. The hopper car according to claim 8 wherein said apparatus further comprises a detent mechanism for releasably holding said rod in a selected position relative to said frame.

10. The hopper car according to claim 8 wherein said apparatus further includes a spring for resiliently biasing said rod and said actuator toward a predetermined linear position.

11. The hopper car according to claim 10 wherein said spring automatically returns said apparatus to a second condition whereby locking said apparatus and thereby said rack and pinion assembly relative to said frame so as to require operator intervention to effect movement of said pan assembly or said door relative to said frame.

12. The hopper car according to claim 11 wherein said apparatus further includes cam structure for automatically placing said apparatus in a locked condition thereby requiring operator intervention when said operating shaft is operated to position said apparatus adjacent an end wall of said frame.

13. The hopper car according to claim 1 further including seal structure arranged in combination with said door and said pan assembly.

14. A railroad hopper car having an enclosure for holding and transporting materials and a discharge opening through which the material in said enclosure is discharged from said hopper car, and a gate assembly for controlling the discharge of material from said hopper car, said gate assembly comprising:

a rigid frame disposed about said discharge opening;

an open top pan assembly having a pneumatic outlet port, said pan assembly being slidably mounted on said frame for movement between a first discharge position beneath said discharge opening and a second position removed from said discharge opening;

a door operably mounted on said frame between said discharge opening and said pan assembly for sliding movement between a closed position beneath said discharge opening and an open position away from said discharge opening;

an apparatus for moving either said pan assembly from said first discharge position to said second position or said door from said closed position to said open position such that said gate assembly can be selectively conditioned for either gravitational or pneumatic discharge of materials;

a single operating shaft carried on said frame for rotation about a fixed axis and arranged in operable combination with said apparatus for imparting independent sliding movements in opposed directions to said pan assembly and said door; and a seal arranged in combination with said operating shaft for visually indicating whether the operating shaft has been operated to move either said door toward an open position or said pan assembly toward said second position.

15. A railroad hopper car having an enclosure for holding and transporting materials and a discharge opening through which the material in said enclosure is discharged from said hopper car, and a gate assembly for controlling the discharge of material from said hopper car, said gate assembly comprising:

a rigid generally rectangularly shaped frame disposed about said discharge opening, said frame including a pair of depending and generally parallel side walls and a pair of depending and generally parallel end walls;

an open top pan assembly having a pneumatic outlet port, said pan assembly being slidably mounted on said frame for reciprocal movement along a generally horizontal path of travel between a first discharge position beneath said discharge opening and a second position removed from said discharge opening;

a door operably mounted on said frame between said discharge opening and said pan assembly for sliding reciprocal movement along a generally horizontal path of travel between a closed position beneath said discharge opening and an open position away from said discharge opening;

a drive mechanism mounted on said frame for moving said pan assembly from said first discharge position to said second position or said door from said closed position to said open position such that said gate assembly can be selectively conditioned for either gravitational or pneumatic discharge of materials; and seal structure extending generally parallel to said end walls of said frame to effectively seal the vertical space between said pan assembly and said door, said seal structure comprising an elongated and hollow elastomeric member configured for energization regardless of the direction of movement of said pan assembly and when compressed between said pan assembly and said door, with said elongated member having a generally centralized mounting portion with an aperture defining an axis extending generally parallel to the path of movement of said door, said elongated member further defining a first radial surface.

16. The railroad hopper car according to claim 15 wherein said drive mechanism includes an operating shaft assembly rotatably mounted on said frame for rotation about a fixed axis and a rack and pinion assembly arranged in operable combination with said operating shaft assembly, said rack and pinion assembly including a pair of laterally spaced racks arranged in generally parallel relation relative to the side walls of said frame.

17. The hopper car according to claim 16 wherein a lengthwise portion of said seal structure is carried by said frame between said door and said pan assembly and between said laterally spaced racks.

18. The hopper car according to claim 15 wherein each radial surface on said elongated member includes a projecting rib extending longitudinally along said radial surface.

* * * * *